US011479900B2

(12) United States Patent
Jin et al.

(10) Patent No.: US 11,479,900 B2
(45) Date of Patent: Oct. 25, 2022

(54) LAUNDRY TREATING APPARATUS

(71) Applicant: LG Electronics Inc., Seoul (KR)

(72) Inventors: Donghyun Jin, Seoul (KR); Minsu Kim, Seoul (KR); Yunhong Park, Seoul (KR)

(73) Assignee: LG Electronics Inc., Seoul (KR)

( * ) Notice: Subject to any disclaimer, the term of this patent is extended or adjusted under 35 U.S.C. 154(b) by 59 days.

(21) Appl. No.: 17/179,731

(22) Filed: Feb. 19, 2021

(65) Prior Publication Data

US 2021/0262143 A1 Aug. 26, 2021

(30) Foreign Application Priority Data

Feb. 20, 2020 (KR) ..... 10-2020-0021056
Oct. 13, 2020 (KR) ..... 10-2020-0132034

(51) Int. Cl.
*D06F 29/00* (2006.01)
*D06F 39/02* (2006.01)
*D06F 39/12* (2006.01)

(52) U.S. Cl.
CPC ..... *D06F 39/02* (2013.01); *D06F 39/12* (2013.01); *D06F 29/005* (2013.01)

(58) Field of Classification Search
CPC ..... D06F 29/005
See application file for complete search history.

(56) References Cited

FOREIGN PATENT DOCUMENTS

| | | |
|---|---|---|
| EP | 2837727 | 2/2015 |
| EP | 2876198 | 5/2015 |
| KR | 10-2018-0090003 | 8/2018 |

OTHER PUBLICATIONS

Extended European Search Report in European Appln. No. 21157961.0, dated Jun. 30, 2021, 8 pages.

*Primary Examiner* — Jason Y Ko
(74) *Attorney, Agent, or Firm* — Fish & Richardson P.C.

(57) ABSTRACT

A laundry treating apparatus includes a cabinet; a tub; a drum; a detergent storage unit retracting or extending into or from the cabinet through a detergent opening; and a protective casing coupled to a front panel and disposed in rear of the detergent opening and surrounding at least a portion of the detergent storage unit retracting into the cabinet, wherein the protective casing has an opening stopper protruding toward the detergent storage unit, wherein the detergent storage unit has a stopper protrusion located in rear of the opening stopper while the detergent storage unit has retracted into the cabinet, wherein during a process of extending the detergent storage unit from the cabinet, the stopper protrusion comes into contact with the opening stopper, thus limiting an extending distance of the detergent storage unit.

20 Claims, 13 Drawing Sheets

LAUNDRY TREATING APPARATUS

CROSS-REFERENCE TO RELATED APPLICATIONS

This application claims the benefit of Korean Patent Application Nos. 10-2020-0021056, filed on Feb. 20, 2020, and 10-2020-0132034, filed on Oct. 13, 2020, the disclosures of which are hereby incorporated by reference as when fully set forth herein.

TECHNICAL FIELD

The present disclosure relates to a laundry treating apparatus, and more specifically, relates to a laundry treating apparatus having a detergent supply.

BACKGROUND

The laundry treating apparatus receives laundry including clothes, bedding, etc. inside a drum and removes contaminations from the laundry. The laundry treating apparatus may perform processes such as washing, rinsing, spinning and drying. The laundry treating apparatus may be classified into a top loading scheme apparatus and a front loading front scheme apparatus based on a scheme in which laundry is injected into the drum.

The laundry treating apparatus may include a cabinet defining an appearance, a tub accommodated inside the cabinet, a drum that is rotatably mounted inside the tub, and into which laundry is injected, and a detergent supply that supplies detergent into the drum.

When the drum rotates by a motor while washing-water is supplied to the laundry contained in the drum, dirt on the laundry may be removed via friction between, the laundry, the drum and the washing-water.

The detergent supply has a detergent supply function to improve the washing effect. In this connection, detergent refers to substances that enhance the washing effect, such as fabric detergent, fabric softener and fabric bleach. Detergent may be used in a powder form and a liquid form.

In one example, a detergent supply is included in a laundry treating apparatus. In the laundry treating apparatus, a user may retract or extend a detergent storage unit of the detergent supply into or from the cabinet.

However, when the detergent storage unit extends completely outside the cabinet, the user fits the detergent storage unit into the detergent opening of the cabinet and retracts the detergent storage unit into the cabinet for use of the laundry treating apparatus. Thus, inconvenient use of the detergent storage unit may occur.

Therefore, variously and efficiently setting an extending distance of the detergent storage unit extending from the cabinet and improving the laundry treating apparatus so that the storage may be conveniently separated from the cabinet according to the user's wish may be required.

SUMMARY

Implementations of the present disclosure are intended to provide a laundry treating apparatus in which an extending distance of the detergent storage unit drawn out from the cabinet may be efficiently set, thereby effectively improving use convenience of the detergent storage unit.

Further, implementations of the present disclosure are intended to provide a laundry treating apparatus in which whether to limit the extending distance of the detergent storage unit may be efficiency determined according to needs of the user, thereby effectively improving use convenience of the detergent storage unit.

Further, implementations of the present disclosure are intended to provide a laundry treating apparatus that a limited extending distance of the detergent storage unit is variously changed, so that the convenience and efficiency of use may be effectively improved.

Purposes of the present disclosure are not limited to the above-mentioned purpose. Other purposes and advantages of the present disclosure as not mentioned above may be understood from following descriptions and more clearly understood from embodiments of the present disclosure. Further, it will be readily appreciated that the purposes and advantages of the present disclosure may be realized by features and combinations thereof as disclosed in the claims.

The laundry treating apparatus according to one implementation of the present disclosure may include a protective casing to prevent corrosion or durability degradation otherwise caused when detergent or washing water is discharged onto a portion of the cabinet around the detergent opening defined in a front panel when a drawer type detergent storage unit extends or retracts from or into the cabinet through the detergent opening. Thus, the protective casing may protect the detergent storage unit.

The protective casing has an opening stopper that extends toward the detergent storage unit so that the extending distance of the detergent storage unit introduced into the cabinet may be effectively limited. The detergent storage unit is drawn out of the cabinet by the extending distance limited by the opening stopper, and thus is not completely separated from the cabinet. Thus, the inconvenience of recombining the detergent storage unit with the cabinet may be removed.

In addition, when the detergent storage unit extends by a predefined extending distance defined by the opening stopper, the detergent receiving space may be exposed to the outside. Thus, even when the user does not completely separate the detergent storage unit from the cabinet, the user may input the detergent to the detergent receiving space, thereby to improve the convenience of use.

In one example, in one implementation of the present disclosure, a stopper bar is included in the detergent storage unit, and a stopper protrusion of the stopper bar has a structure in which a movement thereof is restricted by the opening stopper. When the user presses the stopper bar, the restriction of the extending distance by the opening stopper may be effectively removed, so that the convenience of use may be improved.

In one example, according to one implementation of the present disclosure, the extending distance of the detergent storage unit may be gradually limited or adjusted as necessary using an inner stopper provided inside the cabinet together with the opening stopper of the protective casing.

Particular implementations of the present disclosure provide a laundry treating apparatus that includes a cabinet, a tub, a drum, a detergent storage unit, and a protective casing. The cabinet includes a front panel that defines a detergent opening. The tub is disposed inside the cabinet. The drum is disposed inside the tub and configured to rotate. The detergent storage unit is configured to be retracted into or extended from the cabinet through the detergent opening. The detergent storage unit is configured to receive detergent and supply the received detergent to the drum. The protective casing is coupled to the front panel. The protective casing is disposed behind the detergent opening and surrounds at least a portion of the detergent storage unit that is retracted into the cabinet. The protective casing has an opening stopper protruding toward the detergent storage unit. The detergent storage unit has a stopper protrusion located behind the opening stopper based on the detergent storage unit being retracted into the cabinet. The stopper protrusion of the detergent storage unit is configured to, based on the detergent storage unit being extended from the cabinet, contact the opening stopper of the protective casing.

In some implementations, the apparatus can optionally include one or more of the following features. The protective casing may include an opening protection wall and a rear wall. The opening protection wall may be coupled to the front panel. The opening protection wall may extend rearward from the detergent opening and surround at least a portion of the detergent storage unit that is retracted into the cabinet. The rear wall may be disposed behind the detergent opening and connected to the opening protection wall. The rear wall may define a through-opening configured to allow the detergent storage unit to pass through. The detergent storage unit may have (i) a first portion configured to, based on the detergent storage unit being retracted into the cabinet, be located behind the rear wall, and (ii) a second portion configured to, based on the detergent storage unit being retracted into the cabinet, be located behind the rear wall, be surrounded by the opening protection wall, and contact the rear wall. The opening stopper of the protective casing may protrude from an inner peripheral face of the through-opening of the protective casing toward the detergent storage unit. The detergent storage unit may include a handle positioned at a front end of the detergent storage unit, and a storage frame disposed behind the handle and configured to receive the detergent. The storage frame may include the stopper protrusion. The opening protection wall of the protective casing may be configured to surround the handle based on the detergent storage unit being retracted into the cabinet. The storage frame may be configured to pass through the through-opening of the rear wall of the protective casing. The opening stopper of the protective casing may be configured to be located ahead of the stopper protrusion of the detergent storage unit. The front panel may include an opening extension extending rearward from a periphery of the detergent opening. The protective casing may be coupled to the opening extension and is fixed inside the cabinet. An inner face of the opening extension of the front panel may face toward the detergent opening and be covered with the opening protection wall of the protective casing. The front panel and the opening extension of the front panel may be connected to each other and made from metal. The opening protection wall of the protective casing may include a plastic material and may be constructed to protect the opening extension from the detergent storage unit. The detergent storage unit may include a stopper bar. The stopper bar may include the stopper protrusion. The stopper bar may have a fixed end and a free end opposite to the fixed end. A position of the free end may vary along a protruding direction of the stopper protrusion. The stopper bar of the detergent storage unit may extend along a retracting direction of the detergent storage unit. A front end of the stopper bar may be fixed to the detergent storage unit, and the stopper protrusion may be disposed at a rear end of the stopper bar. The front end of the stopper bar may be configured to, based on the stopper protrusion contacting the opening stopper, be exposed to an outside of the cabinet through the detergent opening. The protective casing may include a rear wall that is located behind the detergent opening and defines a through-opening configured to allow the detergent storage unit to pass through. The opening stopper of the protective casing may be disposed at the rear wall. The detergent storage unit may define a detergent outlet at a rear face of the detergent storage unit. A rear end of a bottom face of the detergent storage unit may be located behind the detergent outlet of the detergent storage unit. The rear end of the bottom face of the detergent storage unit may be configured to, based on the stopper protrusion of the detergent storage unit contacting the opening stopper of the protective casing, be located behind the rear wall. The stopper protrusion of the detergent storage unit may protrude upward from the detergent storage unit. The opening stopper of the protective casing may protrude downward from the protective casing. The apparatus may include a supply casing and a dispenser. The supply casing may be disposed inside the cabinet. A front end of the supply casing may be coupled to the protective casing. The supply casing may be configured to accommodate the detergent storage unit that is retracted into the cabinet. The dispenser may be disposed above the supply casing and configured to supply washing-water to the detergent storage unit. The dispenser may include an inner stopper protruding toward the detergent storage unit. The inner stopper of the dispenser may be located behind the opening stopper of the protective casing. The inner stopper of the dispenser may be configured to be located ahead of the stopper protrusion of the detergent storage unit based on the detergent storage unit being retracted into the cabinet. The opening stopper of the protective casing and the inner stopper of the dispenser may be located above the detergent storage unit and protrude downward. The stopper protrusion of the detergent storage unit may protrude upward from the detergent storage unit. The stopper protrusion of the detergent storage unit may be configured to, based on the detergent storage unit being extended from the cabinet, contact at least one of the opening stopper of the protective casing or the inner stopper of the dispenser to thereby limit an extending distance of the detergent storage unit. The stopper protrusion of the detergent storage unit may overlap with the opening stopper of the protective casing and does not overlap with the inner stopper of the dispenser along the retracting direction of the detergent storage unit to thereby allow the stopper protrusion to bypass the inner stopper of the dispenser and contact the opening stopper of the protective casing based on the detergent storage unit being extended from the cabinet. A first side of the opening stopper of the protective casing may overlap with the inner stopper of the dispenser, and a second side of the opening stopper of the protective casing does not overlap with the inner stopper of the dispenser in the retracting direction of the detergent storage unit. The stopper protrusion of the detergent storage unit may overlap with the second side of the opening stopper of the protective casing in the retracting direction of the detergent storage unit.

Particular implementations of the present disclosure provide a laundry treating apparatus that includes a cabinet, a tub, a drum, a detergent storage unit, an inner stopper, and an opening stopper. The cabinet includes a front panel that defines a detergent opening. The tub is disposed inside the cabinet. The drum is configured to rotate inside the tub. The detergent storage unit is configured to be retracted into or extended from the cabinet through the detergent opening. The detergent storage unit is configured to receive a detergent and supply the detergent to the drum. The inner stopper is disposed inside the cabinet and protrudes toward the detergent storage unit. The opening stopper is located ahead of the inner stopper and protrudes toward the detergent storage unit. The detergent storage unit includes a stopper protrusion configured to, based on the detergent storage unit being retracted into the cabinet, be located behind the inner stopper. The stopper protrusion of the detergent storage unit is configured to, based on the detergent storage unit being extended from the cabinet, contact at least one of the inner stopper or the opening stopper to thereby limit an extending distance of the detergent storage unit.

In some implementations, the apparatus can optionally include one or more of the following features. The apparatus may include a protective casing and a dispenser. The protective casing may be coupled to an inner face of the front panel. The detergent storage unit may be configured to pass through the protective casing. The protective casing may include the opening stopper. The dispenser may be located behind the protective casing and configured to supply washing-water to the detergent storage unit. The dispenser may include the inner stopper. The detergent storage unit may have a bypass region defined at the stopper protrusion. The bypass region may be open along a retracting direction of the detergent storage unit. The inner stopper may face the bypass region along the retracting direction of the detergent storage unit. The inner stopper may be configured to, based on the detergent storage unit being extended from the cabinet, pass through the bypass region. The stopper protrusion of the detergent storage unit may be configured to, based on the detergent storage unit being extended from the cabinet, contact the opening stopper, to thereby limit the extending distance of the detergent storage unit.

One aspect of the present disclosure provides a laundry treating apparatus comprising: a cabinet including a front panel having a detergent opening defined therein; a tub disposed inside the cabinet; a drum rotatably disposed inside the tub; a detergent storage unit retracting or extending into or from the cabinet through the detergent opening, wherein detergent to be supplied to the drum is stored in the detergent storage unit; and a protective casing coupled to the front panel and disposed in rear of the detergent opening and surrounding at least a portion of the detergent storage unit retracting into the cabinet, wherein the protective casing has an opening stopper protruding toward the detergent storage unit.

In one implementation, the detergent storage unit has a stopper protrusion located in rear of the opening stopper while the detergent storage unit has retracted into the cabinet, wherein during a process of extending the detergent storage unit from the cabinet, the stopper protrusion comes into contact with the opening stopper, thus limiting an extending distance of the detergent storage unit.

That is, according to an implementation of the present disclosure, the extending distance of the detergent storage unit is effectively limited using the opening stopper disposed on the protective casing, so that user convenience may be effectively improved.

In one implementation, the protective casing further includes: an opening protection wall coupled to the front panel, and extending rearward from the detergent opening and surrounding at least a portion of the detergent storage unit retracting into the cabinet; and a rear wall disposed in rear of the detergent opening and connected to the opening protection wall, wherein the rear wall has a through-opening defined therein which the detergent storage unit passes through.

In one implementation, while the detergent storage unit has retracted into the cabinet, a portion of the detergent storage unit is located in rear of the rear wall, and a rest portion of the detergent storage unit is surrounded with the opening protection wall and is supported forwards by the rear wall, such that a retracting distance of the detergent storage unit into the cabinet is limited.

In one implementation, the opening stopper is disposed on the rear wall. In one implementation, the opening stopper protrudes from an inner peripheral face of the through-opening toward the detergent storage unit.

In one implementation, the detergent storage unit includes: a handle on a front end of the detergent storage unit; and a storage frame disposed in rear of the handle, wherein the detergent is stored in the storage frame, wherein the storage frame includes the stopper protrusion, wherein the protective casing is constructed so that the opening protection wall thereof surrounds the handle while the detergent storage unit has retracted into the cabinet, wherein the storage frame passes through the through-opening of the rear wall, and the opening stopper is located in front of the stopper protrusion.

In one implementation, the front panel includes an opening extension extending rearward from a periphery of the detergent opening, wherein the protective casing is coupled to the opening extension and is fixedly disposed inside the cabinet.

In one implementation, the inner face of the opening extension facing toward the detergent opening is covered with the opening protection wall of the protective casing.

In one implementation, the front panel and the opening extension are made of metal, and are integral with each other, wherein the opening protection wall is made of a plastic material and is constructed to protect the opening extension from the detergent storage unit.

In one implementation, the detergent storage unit further includes a stopper bar including the stopper protrusion, wherein the stopper bar has one fixed end and the other end whose a position varies along a protruding direction of the stopper protrusion.

In one implementation, the stopper bar extends along a front and rear direction of the detergent storage unit, a front end of the stopper bar is fixed to the detergent storage unit, and the stopper protrusion is disposed on a rear end of the stopper bar, wherein while the stopper protrusion is in contact with the opening stopper, the front end is exposed to an outside of the cabinet through the detergent opening.

In one implementation, the protective casing includes a rear wall located in rear of the detergent opening, and having a through-opening defined therein through which the detergent storage unit passes, wherein the opening stopper is disposed on the rear wall, wherein a detergent outlet is defined in a rear face of the detergent storage unit, wherein a bottom face of the detergent storage unit extends so that a rear end of the bottom face is located in rear of the detergent outlet, wherein while the stopper protrusion is in contact with the opening stopper, the rear end thereof is located in rear of the rear wall.

In one implementation, the stopper protrusion protrudes upward from the detergent storage unit, wherein the opening stopper protrudes downward from the protective casing.

In one implementation, the apparatus further comprises: a supply casing disposed inside the cabinet, wherein a front end of the supply casing is coupled to the protective casing, wherein the supply casing accommodates therein the detergent storage unit retracting into the cabinet; and a dispenser disposed above the supply casing and supplying washing-water to the detergent storage unit, wherein the dispenser includes an inner stopper protruding toward the detergent storage unit.

In one implementation, the inner stopper is located in rear of the opening stopper, wherein the inner stopper is located in front of the stopper protrusion while the detergent storage unit has retracted into the cabinet.

In one implementation, the opening stopper and the inner stopper are located above the detergent storage unit and protrude downward, wherein the stopper protrusion protrudes upward from the detergent storage unit, wherein during an extending process of the detergent storage unit, the stopper protrusion contacts at least one of the opening stopper or the inner stopper such that an extending distance of the detergent storage unit is limited.

In one implementation, the stopper protrusion overlaps with the opening stopper and does not overlap with the inner stopper along the front and rear direction, such that the stopper protrusion bypasses the inner stopper and contacts the opening stopper during the extending process of the detergent storage unit.

In one implementation, the opening stopper is constructed so that one side thereof overlaps with the inner stopper and the other side thereof does not overlap with the inner stopper in the front and rear direction, wherein the stopper protrusion is constructed to overlap with the other side of the opening stopper in the front and rear direction.

In one implementation, the opening stopper is constructed such that at least a portion thereof overlaps the inner stopper in the front and rear direction, wherein the stopper protrusion is configured to contact the inner stopper and the opening stopper in a sequential manner during the extending process of the detergent storage unit, such that an extending distance of the detergent storage unit is limited in a stepwise manner.

In one implementation, the stopper bar has the front end exposed to an outside of the cabinet through the detergent opening while the stopper protrusion is in contact with the inner stopper.

Further, another aspect of the present disclosure provides a laundry treating apparatus comprising: a cabinet including a front panel having a detergent opening defined therein; a tub disposed inside the cabinet; a drum rotatably disposed inside the tub; a detergent storage unit retracting or extending into or from the cabinet through the detergent opening, wherein detergent to be supplied to the drum is stored in the detergent storage unit; an inner stopper disposed inside the cabinet and protruding toward the detergent storage unit; an opening stopper located in front of the inner stopper, and protruding toward the detergent storage unit; and a stopper protrusion disposed on the detergent storage unit, wherein the stopper protrusion is located in rear of the inner stopper while the detergent storage unit has retracted into the cabinet, wherein the stopper protrusion contacts at least one of the inner stopper or the opening stopper during an extending process of the detergent storage unit such that an extending distance of the detergent storage unit is limited.

In one implementation of another aspect, the apparatus further comprises: a protective casing coupled to an inner face of the front panel, wherein the detergent storage unit passes through the protective casing, wherein the protective casing includes the opening stopper; and a dispenser located in rear of the protective casing, and supplying washing-water to the detergent storage unit, wherein the dispenser includes the inner stopper.

In one implementation of another aspect, the detergent storage unit has a bypass region defined on a side of the stopper protrusion, wherein the bypass region is open along a front and rear direction of the detergent storage unit, wherein the inner stopper is constructed to face the bypass region along the front and rear direction, wherein during a process of extending the detergent storage unit, the inner stopper passes through the bypass region, and the stopper protrusion is in contact with the opening stopper such that an extending distance of the detergent storage unit is limited.

As described above, the implementations of the present disclosure may effectively and variously limit the extending distance of the detergent storage unit using the opening stopper and the inner stopper, and may effectively select the limited extending distance of the detergent storage unit using the stopper bar and the stopper protrusion.

The implementations of the present disclosure may realize the laundry treating apparatus in which the extending distance of the detergent storage unit drawn out from the cabinet may be efficiently set, thereby effectively improving use convenience of the detergent storage unit.

Further, the implementations of the present disclosure may realize the laundry treating apparatus in which whether to limit the extending distance of the detergent storage unit may be efficiency determined according to needs of the user, thereby effectively improving use convenience of the detergent storage unit.

Further, the implementations of the present disclosure may realize the laundry treating apparatus that a limited extending distance of the detergent storage unit is variously changed, so that the convenience and efficiency of use may be effectively improved.

In addition to the effects as described above, specific effects of the present disclosure will be described together with the detailed description for carrying out the disclosure.

DETAILED DESCRIPTION

Figure 1:
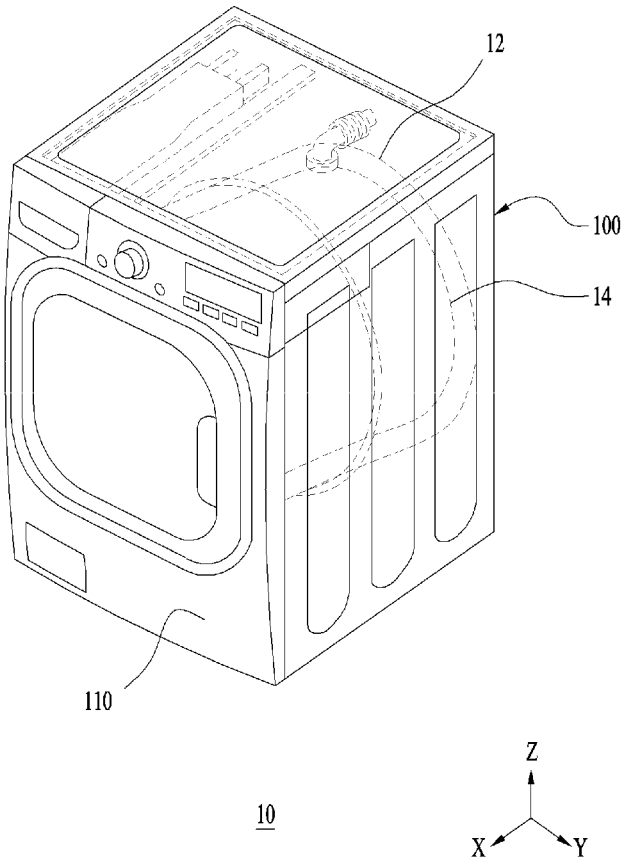
FIG. 1 is a diagram showing a laundry treating apparatus according to one implementation of the present disclosure.

Hereinafter, a laundry treating apparatus according to an embodiment of the present disclosure will be described in detail.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

For simplicity and clarity of illustration, elements in the FIGS. are not necessarily drawn to scale. The same reference numbers in different FIGS. denote the same or similar elements, and as such perform similar functionality. Moreover, descriptions and details of well-known steps and elements are omitted for simplicity of the description. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

In addition, it will also be understood that when a first element or layer is referred to as being present "on" a second element or layer, the first element may be disposed directly on the second element or may be disposed indirectly on the second element with a third element or layer being disposed between the first and second elements or layers. It will be understood that when an element or layer is referred to as being "connected to", or "coupled to" another element or layer, it may be directly on, connected to, or coupled to the other element or layer, or one or more intervening elements or layers may be present. In addition, it will also be understood that when an element or layer is referred to as being "between" two elements or layers, it may be the only element or layer between the two elements or layers, or one or more intervening elements or layers may also be present.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof.

As used herein, the term "and/or" includes any and all combinations of one or more of the associated listed items. Expression such as "at least one of" when preceding a list of elements may modify the entire list of elements and may not modify the individual elements of the list.

FIG. 1 is a perspective view of a laundry treating apparatus 10 according to one implementation of the present disclosure. Referring to FIG. 1, the laundry treating apparatus 10 according to one implementation of the present disclosure may include a cabinet 100 including a front panel 110 having a detergent opening 120 defined therein, a tub 12 disposed inside the cabinet 100, and a drum 14 rotatably disposed inside the tub 12.

Specifically, the laundry treating apparatus 10 may include a washing machine in which laundry is inserted into a washing tub to perform washing, rinsing and dehydration of the laundry, or a dryer in which wet laundry is inserted to perform drying thereof.

The laundry treating apparatus 10 may be classified into a top load scheme apparatus and a front load scheme apparatus.

FIG. 1 shows the laundry treating apparatus 10 as the front load scheme apparatus. This is only for convenience of description. The present disclosure may be applied not only to the washing machine as the front load scheme apparatus, but also to the washing machine as the top load scheme apparatus.

As shown in FIG. 1, the laundry treating apparatus 10 includes the cabinet 100 that defines the appearance thereof. The cabinet 100 may have the front panel 110. A detergent opening 120 may be defined in the front panel 110. A detergent storage unit 300 which will be described later may retract or extend into or from the cabinet 100 through the detergent opening 120.

In one example, the cabinet 100 may have a manipulator having a display that displays information on an operating state while receiving various control commands from the user. The manipulator may be disposed on the front panel 110 or a separate control panel.

Further, the cabinet 100 may have a door installed on the front panel 110. The door is pivotally disposed on the cabinet 100 to control entry and exit of the laundry into and from the drum 14.

The cabinet 100 defines the appearance of the laundry treating apparatus 10. The cabinet 100 may have an inner space defined therein in which various components constituting the laundry treating apparatus 10 may be accommodated. Inside the cabinet 100, the drum 14 may be installed to accommodate therein the laundry input through an laundry inlet.

Specifically, the cabinet 100 may receive the tub 12 containing washing-water, and the drum 14 that is rotatably disposed inside the tub 12 to accommodate laundry therein. A balancer to compensate for eccentricity caused by rotation may be installed at one side of the drum 14.

The manipulator may include various keys for controlling the operation state of the laundry treating apparatus 10 and the display for displaying the operation state of the laundry treating apparatus 10. The door may include a transparent member such as a tempered glass so that the interior of the cabinet 100 or the drum 14 may be visually identified.

In one example, in one implementation of the present disclosure, the laundry treating apparatus 10, the detergent opening 120 may be defined in the front panel 110. The detergent storage unit 300 may retract into the cabinet 100 through the detergent opening 120. Detergent to be supplied to the drum 14 may be stored inside the detergent storage unit 300. A detergent supply may be disposed in rear of the opening and in the cabinet 100. The detergent storage unit 300 may define a portion of the detergent supply inside the cabinet 100.

A location and a shape of the detergent opening 120 may vary. FIG. 1 shows an example in which the detergent opening 120 is opened frontwards in the front panel 110 of the cabinet 100. The detergent opening 120 may be located in a corner area at a front face of the cabinet 100, for example, on one side of a top portion of the front panel 110.

The detergent supply may be located inside the cabinet 100 and in rear of the detergent opening 120. The detergent supply may include the detergent storage unit 300 that may store detergent therein, a dispenser 450 that is located above the detergent storage unit 300 and supplies water to the detergent storage unit 300, and a supply casing 400 that accommodates therein the detergent storage unit 300 retracting into the cabinet.

The detergent supply serves to automatically supply the detergent stored in the detergent storage unit 300 into the drum 14 during the washing step. Detergent refers to a substance that may enhance the laundry effect of the laundry, and may include powder based or liquid based fabric detergent and fabric softener.

Figure 2:
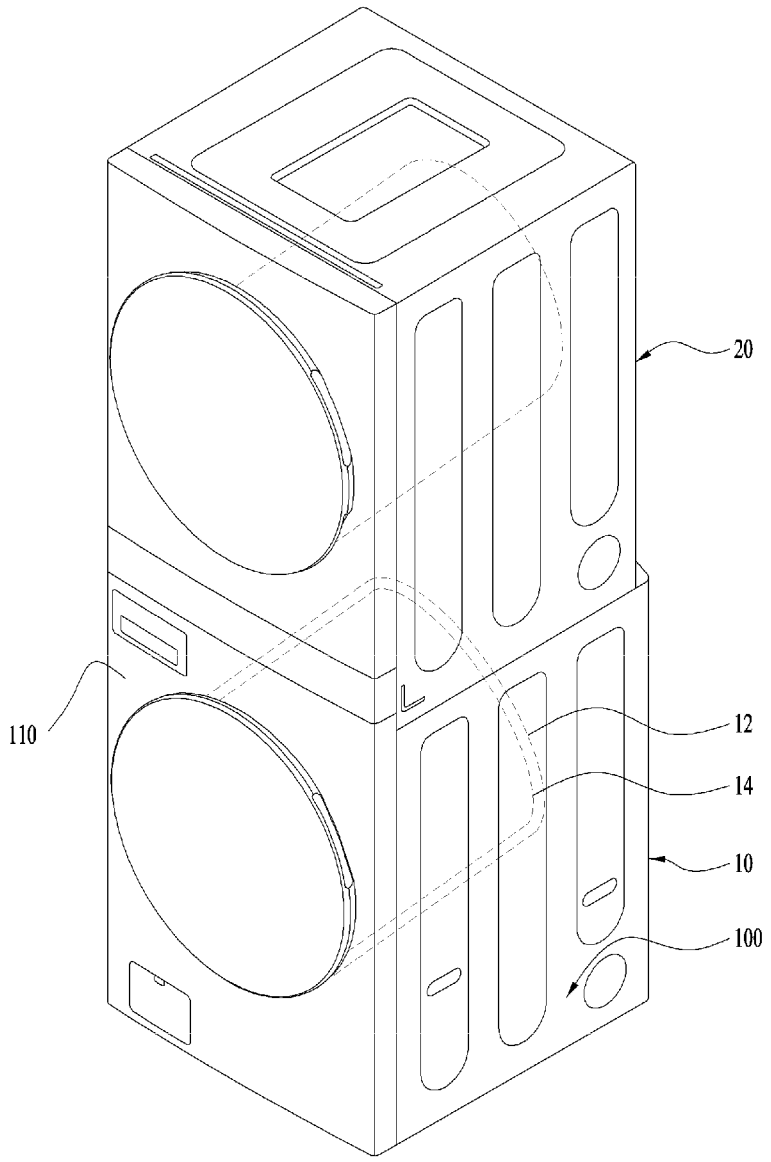
FIG. 2 is a diagram showing a stack-type laundry treating apparatus including upper and lower laundry treating apparatuses according to one implementation of the present disclosure.

In one example, FIG. 2 shows a stack-type laundry treating apparatus including lower and upper laundry treating apparatuses 10 and 20 according to one implementation of the present disclosure. The upper laundry treating apparatus 10 according to one implementation of the present disclosure may be stacked on the lower laundry treating apparatus 20. In this case, the laundry treating apparatuses 10 and 20 may be stacked vertically and be coupled to each other. A control panel may be disposed between front panels 110 of the laundry treating apparatuses 10 and 20.

The control panel may communicate a signal with the upper laundry treating apparatus 20 and/or the lower laundry treating apparatus 10, and may include a display that provides information on each of the laundry treating apparatuses 10 and 20 and a manipulator for controlling each of the laundry treating apparatuses 10 and 20.

As shown in FIG. 2, when a plurality of laundry treating apparatus 10 and 20 are stacked vertically, a single control panel may be used to control or display operating states of the plurality of laundry treating apparatuses 10 and 20 together.

Figure 3:
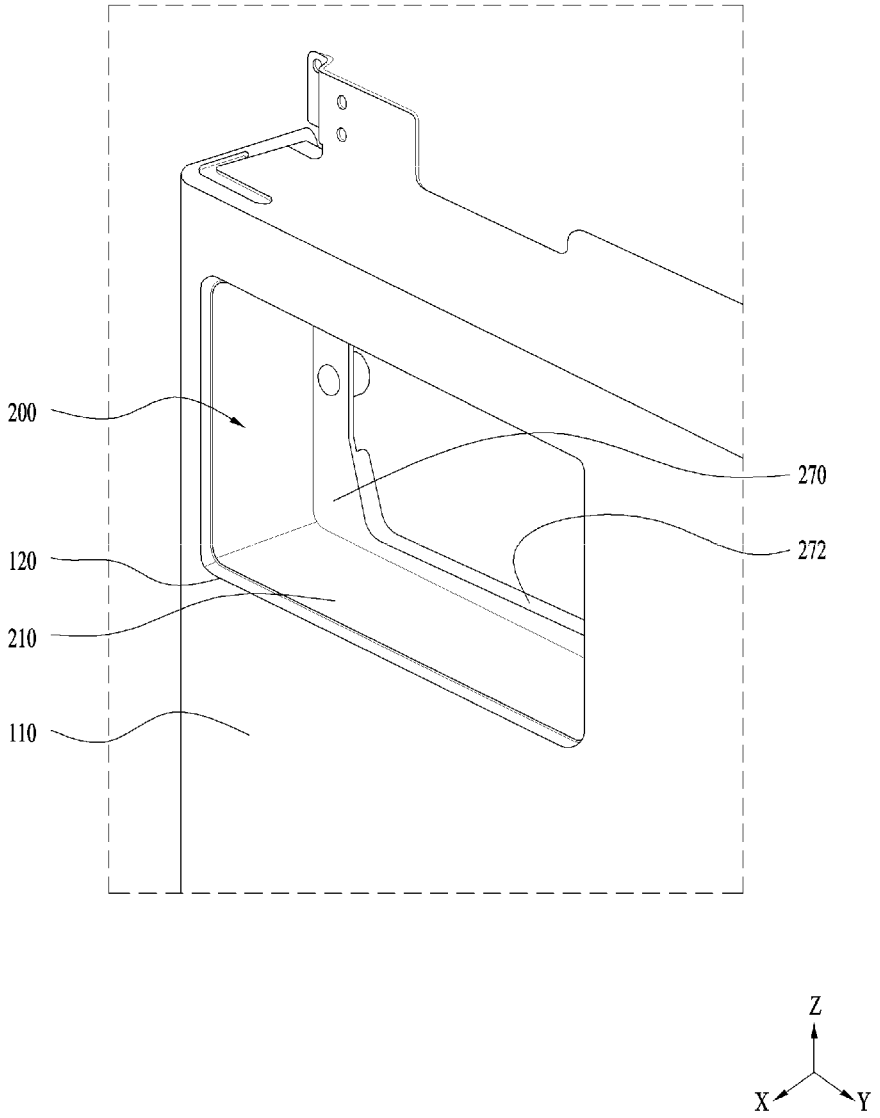
FIG. 3 is a perspective view showing a detergent opening and a protective casing disposed in a front panel of a laundry treating apparatus according to one implementation of the present disclosure.
Figure 5:
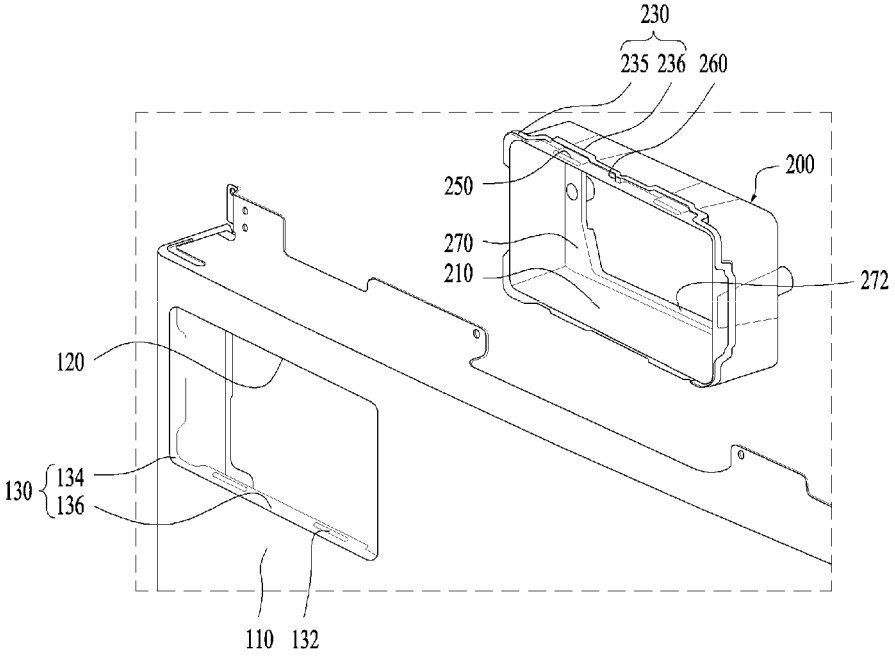
FIG. 5 is a perspective view showing a state in which the protective casing of FIG. 3 is spaced from the front panel.

In one example, FIG. 3 shows the front panel 110 of the cabinet 100 and a protective casing 200 coupled to the front panel 110 in the laundry treating apparatus 10 according to one implementation of the present disclosure. A side cross-section view of the protective casing 200 is shown in FIG. 3. In FIG. 5, the protective casing 200 in FIG. 3 is spaced from the front panel 110.

Figure 4:
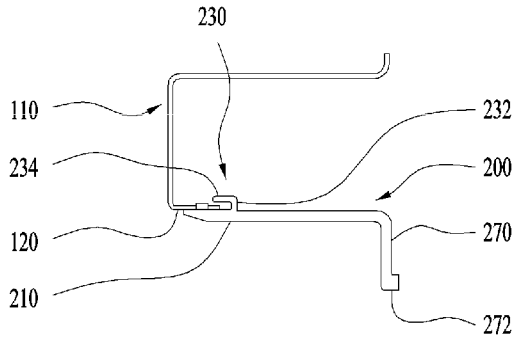
FIG. 4 is a diagram showing a cross section of the protective casing coupled to an opening extension in a laundry treating apparatus according to one implementation of the present disclosure.
Figure 4:
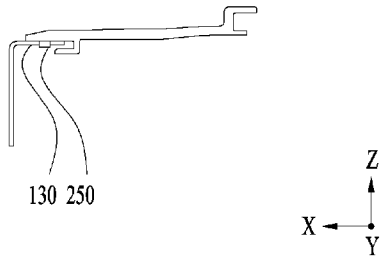

Referring to FIGS. 3 to 5, the laundry treating apparatus 10 according to one implementation of the present disclosure may further include an opening extension 130 in the front panel 110. The protective casing 200 has an opening protection wall 210. The protective casing 200 may be coupled to the front panel 110.

Specifically, the front panel 110 of the cabinet 100 may have the opening extension 130 defined therein that surrounds at least a portion of the detergent opening 120 and extends inwardly of the cabinet 100.

The protective casing 200 is coupled to the opening extension 130 and is disposed inside the cabinet 100. The protective casing 200 may be constructed such that the detergent storage unit 300 passes through the protective casing 200.

The protective casing 200 may include the opening protection wall 210 that has at least a portion covering an inner face of the opening extension 130 facing toward the detergent opening 120 to protect the opening extension 130.

The opening extension 130 may extend rearward from the cabinet 100, and may be constructed to surround at least a portion of the detergent opening 120. The opening extension 130 may have a ring-shaped closed section extending along a perimeter of the detergent opening 120.

For example, when the detergent opening 120 has a circular cross section, the opening extension 130 may also have a circular ring shape surrounding the detergent opening 120. When the detergent opening 120 has a polygonal cross-sectional shape, the opening extension 130 may also have a polygonal ring shape corresponding to the detergent opening 120.

The opening extension 130 may be manufactured separately from the front panel 110 and then coupled to a rear face of the front panel 110 or may be integral with the front panel 110. When the opening extension 130 is integral with the front panel 110, the opening extension 130 may have a bent shape extending rearwards from the periphery of the detergent opening 120 of the front panel 110.

FIG. 5 shows the opening extension 130 that extends rearwards from the periphery of the detergent opening 120 and defines a portion of the front panel 110 according to one implementation of the present disclosure.

In one example, the protective casing 200 may be coupled to the opening extension 130 and may be disposed inside the cabinet 100. The protective casing 200 may be disposed on a rear face of the front panel 110 and coupled to the opening extension 130, and may have a ring-shaped cross section corresponding to a shape of the opening extension 130.

Therefore, when the detergent storage unit 300 retracts into the cabinet 100 through the detergent opening 120, the detergent storage unit 300 passes through the opening extension 130 and the protective casing 200 and may retract into the cabinet 100. In other words, the detergent storage unit 300 may be constructed such that when the detergent storage unit 300 retracts into the cabinet 100, at least a portion thereof passes through a center of the protective casing 200 and is surrounded by the protective casing 200.

In FIG. 5, according to one implementation of the present disclosure, the detergent opening 120 has an approximately rectangular cross section. The opening extension 130 may be embodied as a ring having an approximately rectangular cross section corresponding to that of the detergent opening 120. The protective casing 200 has an approximately rectangular ring cross section corresponding to that of the opening extension 130.

In one example, the protective casing 200 may include the opening protection wall 210. The opening protection wall 210 may be constructed such that at least a portion of an outer face thereof away from the detergent opening 120 covers an inner face of the opening extension 130 facing toward the detergent opening 120. That is, the opening protection wall 210 may be coupled to the front panel 110, and extend rearward from the detergent opening 120.

The opening protection wall 210 may be constructed to cover the opening extension 130 while being in direct contact with or spaced apart from an inner face of the opening extension 130 to prevent the opening extension 130 from being exposed to the outside.

The opening protection wall 210 may have a ring shape extending in a front and rear direction X of the cabinet 100. For example, the opening protection wall 210 may have a ring-shaped cross section having a diameter smaller than that of the opening extension 130. The opening protection wall 210 may be constructed to cover at least a portion of the detergent storage unit 300 that retracts into cabinet 100.

The protective casing 200 is constructed to be coupled to the opening extension 130, and to have the opening protection wall 210 covering the inner face of the opening extension 130, thus preventing the opening extension 130 from being exposed to the outside and protecting the opening extension 130.

Specifically, the laundry treating apparatus 10 according to one implementation of the present disclosure may be a washing machine in which detergent and washing-water are used. The detergent storage unit 300 retracting or extending through the detergent opening 120 may contain detergent or water therein.

The opening extension 130 surrounding the detergent opening 120 in which the detergent storage unit 300 is located may act as a frame that supports the detergent storage unit 300 or which is coupled to the detergent supply inside the cabinet 100 to secure rigidity to support the detergent supply.

However, the opening extension 130 may be formed as a portion of the cabinet 100 during a forming process of the cabinet 100, and may be made of a metal material as in the cabinet 100. Accordingly, when water or detergent present in the detergent storage unit 300 comes into contact with the opening extension 130, corrosion of the opening extension 130 may occur.

Further, an outer face and an inner face of the opening extension 130 may be coated with a polymer, etc. as in the cabinet 100 such that a coating having corrosion resistance is formed thereon. Even when such a coating is formed, the coating may not protect a rear end of the opening extension 130 from corrosion due to a thickness and a manufacturing process of the front panel 110.

Furthermore, the rear end of the opening extension 130 may have an edge toward the detergent opening 120. This edge may damage the outer surface of the detergent storage unit 300 during the retracting or extending process of the detergent storage unit 300.

Accordingly, one implementation of the present disclosure includes the protective casing 200 coupled to the opening extension 130, wherein the protective casing 200 has the opening protection wall 210 covering the inner face of the opening extension 130.

The opening protection wall 210 covers the inner face of the opening extension 130 so that the opening extension 130 or the rear end of the opening extension 130 is not exposed. Thus, water or detergent that may be transferred from the detergent storage unit 300 may be effectively prevented from being in direct contact with the opening extension 130, which otherwise causes corrosion. Further, the damage to the outer surface of the detergent storage unit 300 by the opening extension 130 be effectively prevented.

Further, in one implementation of the present disclosure, the opening protection wall 210 surrounds the detergent opening 120 and is located between the opening extension 130 and the detergent storage unit 300, and screens at least a portion of the inner face of the opening extension 130.

Accordingly, one implementation of the present disclosure may have a structure in which the opening protection wall 210 and the opening extension 130 are sequentially stacked in a direction from a center of the detergent opening 120 to an outside as shown in FIG. 4. The opening protection wall 210 may be constructed to screen an entirety of the opening extension 130 as shown in FIG. 3 or to screen at least a rear end of the opening extension 130.

In one example, as described above, in one implementation of the present disclosure, the front panel 110 may be made of a metal material, and the protective casing 200 may include a plastic material.

Alternatively, in one implementation of the present disclosure, the opening extension 130 may be made of a metal material, and the opening protection wall 210 of the protective casing 200 may be made of a plastic material.

The opening extension 130 may be formed integrally with the front panel 110, and may be made of a metal material to secure the rigidity of the detergent supply or the supporting force of the detergent storage unit 300. The opening protection wall 210 may be made of a plastic material that has corrosion resistance so that the wall 210 is not corroded by water or detergent.

Accordingly, even when the opening extension 130 is made of the metal material to secure the rigidity to support the detergent storage unit 300 or the detergent supply, the protective casing 200 or the opening protection wall 210 is made of a plastic material that may have corrosion resistance to prevent corrosion of the opening extension 130 which otherwise may occur due to water or detergent that may leak from the detergent storage unit 300.

In one example, FIGS. 4 and 5 show an opening coupler 230 of the protective casing 200 to which the opening extension 130 is coupled. As shown in FIGS. 4 and 5, in one implementation of the present disclosure, the protective casing 200 may further include the opening coupler 230.

The opening coupler 230 is disposed on the outer face of the opening protection wall 210. The opening extension 130 is inserted in a front to rear direction and is coupled to the opening coupler 230. Specifically, the opening coupler 230 may protrude from an outer face of the opening protection wall 210 facing toward an opposite side of the detergent opening 120 in a direction away from the detergent opening 120.

The opening coupler 230 may have a ring shape extending in the circumferential direction of the detergent opening 120 along the circumference of the opening protection wall 210 and surrounding the detergent opening 120. The rear end of the opening extension 130 may be inserted into the opening coupler 230 in a front to rear direction. The opening protection wall 210 may move in a rear to front direction of the front panel 110 and may be inserted into the opening extension 130.

The opening coupler 230 extending outwards from the outer face of the opening protection wall 210 and extending in the circumferential direction of the detergent opening 120 may be coupled to the opening extension 130, such that the protective casing 200 may be fixed to a rear side of the detergent opening 120 defined in the front panel 110. FIG. 4 shows the opening coupler 230 which the opening extension 130 inserted into and coupled to.

Figure 6:
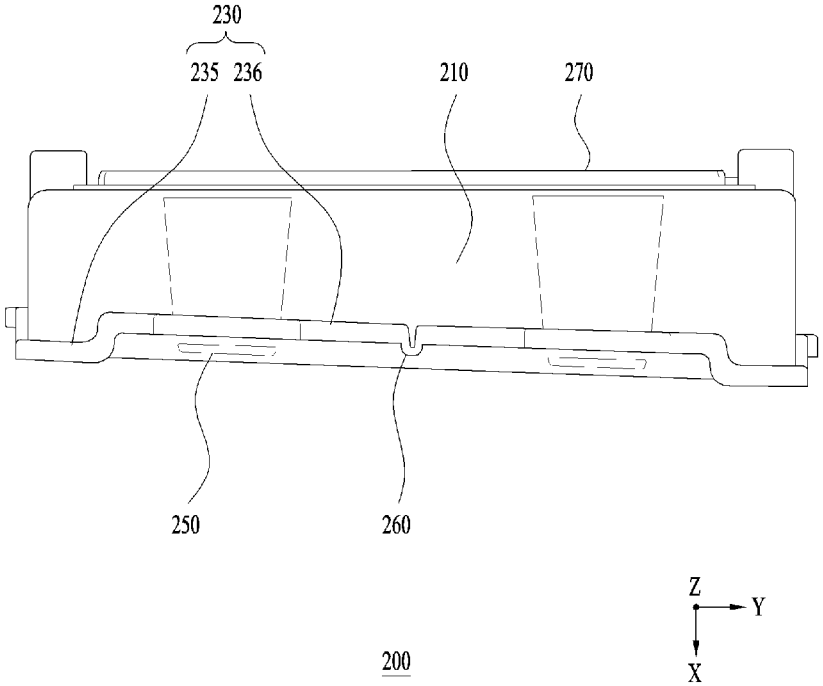
FIG. 6 is a top view of the protective casing in the laundry treating apparatus according to one implementation of the present disclosure.
Figure 7:
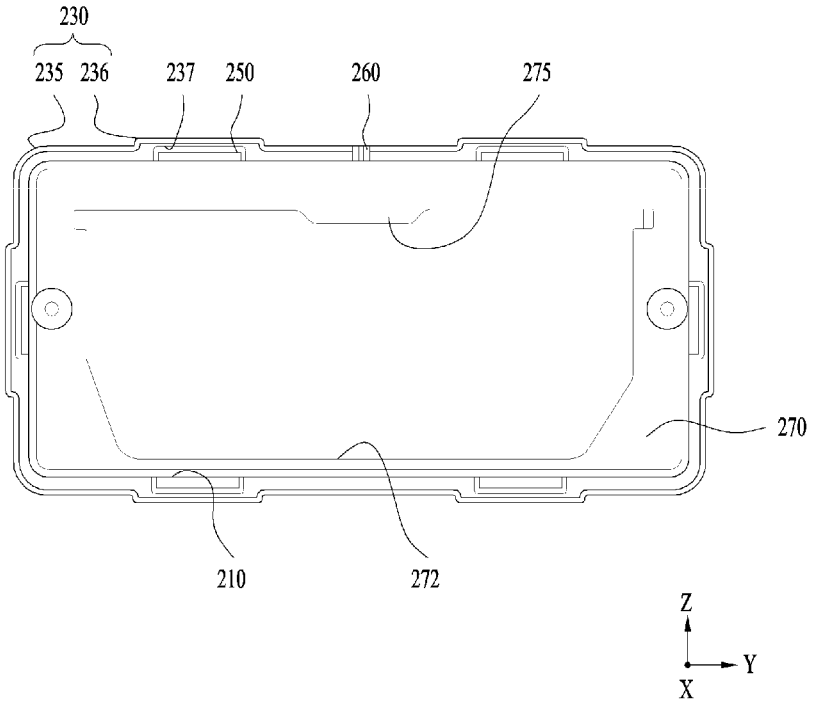
FIG. 7 is a front view of the protective casing in the laundry treating apparatus according to one implementation of the present disclosure.

In one example, FIG. 6 shows a top view of the protective casing 200 according to one implementation of the present disclosure. FIG. 7 shows a front view of the protective casing 200 according to one implementation of the present disclosure.

Referring to FIGS. 4 to 7, in the laundry treating apparatus 10 according to one implementation of the present disclosure, the opening coupler 230 may include an outward extension 232 and a frontward extension 234.

The outward extension 232 may extend outwards from the outer face of the opening protection wall 210. The frontward extension 234 may extend forwards from the outward extension 232 and may be spaced from the opening protection wall 210. The opening extension 130 may be inserted into between the opening protection wall 210 and the frontward extension 234.

Specifically, the outward extension 232 may protrude outwards from the outer face of the opening protection wall 210 and extend along the circumferential direction of the detergent opening 120. A vertical dimension by which the outward extension 232 protrudes from the outer face of the opening protection wall 210 may vary as necessary.

The frontward extension 234 may extend forwards from the outward extension 232. The frontward extension 234 may have a closed cross-section extending along the circumferential direction of the detergent opening 120. That is, the frontward extension 234 may have a sleeve shape spaced outwards from the opening protection wall 210.

FIG. 4 shows a side cross-sectional view of the outward extension 232 and frontward extension 234. FIG. 6 shows that the frontward extension 234 is spaced from the opening protection wall 210 in a direction away from the detergent opening 120. FIG. 7 shows the outward extension 232 which protrudes outwards from the opening protection wall 210 and extends along the circumferential direction of the detergent opening 120.

The frontward extension 234 may extend forwards from an end of the outward extension 232. That is, the frontward extension 234 may extend forwardly while being spaced apart from the opening protection wall 210 by the vertical dimension by which the outward extension 232 protrudes.

The opening extension 130 of the front panel 110 may be inserted into a space between the frontward extension 234 and the opening protection wall 210. The protrusion vertical dimension of the outward extension 232 may be equal to or greater than a thickness of the opening extension 130.

The frontward extension 234 may extend forwards while being spaced from the opening protection wall 210 via the outward extension 232, such that a space into which the opening extension 130 may be inserted in a front to rear direction may be defined between the frontward extension 234 and the opening protection wall 210. Thus, the opening extension 130 is inserted into the space by a length of the frontward extension 234 and is coupled to the opening coupler 230, thereby improving a coupling force therebetween.

In one example, in one implementation of the present disclosure, the opening protection wall 210 may extend so that a front end thereof is positioned in front of a front end of the frontward extension 234.

The front end of the opening protection wall 210 may be located in front of the opening coupler 230 to increase an screening area of the opening extension 130, and may be positioned in front of a front end of the frontward extension 234 of the opening coupler 230.

For example, the front end of the opening protection wall 210 may be positioned adjacent to a front face of the front panel 110 or may be positioned in a parallel manner to the front face thereof. On the contrary, the frontward extension 234 extends forward from the outward extension 232. The front end of the frontward extension 234 may be located in rear of a rear face of the front panel 110.

In one example, in one implementation of the present disclosure, the protective casing 200 may include an opening coupling protrusion 250. The opening extension 130 may include a protrusion receiving portion 132 into which the opening coupling protrusion 250 is inserted.

The opening coupling protrusion 250 may protrude outwards from the outer face of the opening protection wall 210. A shape of the opening coupling protrusion 250 may vary. A vertical dimension by which the opening coupling protrusion 250 protrudes from the opening protection wall 210 may vary, and preferably, may be smaller than a vertical dimension by which the outward extension 232 protrudes.

FIGS. 6 and 7 show the opening coupling protrusion 250 protruding from the opening protection wall 210 and having a length extending along a perimeter of the protective casing 200 according to one implementation of the present disclosure.

In one example, the opening extension 130 may have a protrusion receiving portion 132 into which the opening coupling protrusion 250 is inserted. The protrusion receiving portion 132 may be embodied as a groove into which the opening coupling protrusion 250 is inserted, or may be embodied as a hole through which the opening coupling protrusion 250 passes. FIG. 5 shows that the protrusion receiving portion 132 is embodied as a hole defined in the opening extension 130 according to one implementation of the present disclosure.

The opening coupling protrusion 250 of the protective casing 200 may be inserted into the protrusion receiving portion 132 of the opening extension 130 while the opening extension 130 is inserted into the opening coupler 230. As the opening coupling protrusion 250 is inserted into and coupled to the protrusion receiving portion 132, the protective casing 200 may be prevented from moving in the front and rear direction X while the opening extension 130 is inserted into the opening coupler 230.

In one example, as shown in FIG. 6, in one implementation of the present disclosure, the opening coupling protrusion 250 may be located in front of the front end of the frontward extension 234. The opening extension 130 may be pressed outwardly of the opening protection wall 210 by the opening coupling protrusion 250 until the opening coupling protrusion 250 is inserted into the protrusion receiving portion 132.

Accordingly, when the opening coupling protrusion 250 is located between the frontward extension 234 and the opening protection wall 210, that is, in rear of the front end of the frontward extension 234, the opening coupling protrusion 250 may not be easily inserted into or separated from the protrusion receiving portion 132 due to interference with the frontward extension 234, and the opening extension 130 may not be easily inserted into between the frontward extension 234 and the opening protection wall 210.

Accordingly, in one implementation of the present disclosure, the opening coupling protrusion 250 is positioned in front of the front end of the frontward extension 234 as shown in FIG. 6. The opening extension 130 may be easily inserted into between the frontward extension 234 and the opening protection wall 210 and, at the same time, the opening coupling protrusion 250 may be easily inserted or separated into or from the protrusion receiving portion 132.

In one example, referring to FIG. 5, in the laundry treating apparatus 10 according to one implementation of the present disclosure, the opening extension 130 may include a first extension 134 and a second extension 136. The first extension 134 may extend rearward from the front panel 110 by a first length. The second extension 136 may extend rearward from the front panel 110 by a second length longer than the first length. The protrusion receiving portion 132 may be defined in the second extension 136.

Specifically, the first extension 134 and the second extension 136 may be constructed to be connected to each other and to extend along the circumferential direction of the detergent opening 120 and to surround the detergent opening 120. That is, the a portion of the opening extension 130 may define the first extension 134, and the other portion except for the first extension 134 may define the second extension 136 that extends by a larger length than that of the first extension 134.

The second extension 136 may has the protrusion receiving portion 132 defined therein. A width of the protrusion receiving portion 132 in the front and rear direction X may be greater than a width of the opening coupling protrusion 250, and the second extension 136 should have the protrusion receiving portion 132 defined therein having a width larger than that of the opening coupling protrusion 250. Thus, the second extension 136 may extend by a larger length than that of the first extension 134 and may have a design margin to define the protrusion receiving portion 132 therein.

However, a difference between the extending lengths of the first extension 134 and the second extension 136 may not be necessarily equal to the width of the protrusion receiving portion 132. For example, the second extension 136 may extend from the first extension 134 by a smaller or larger length than the width of the protrusion receiving portion 132.

The extending length of each of the first extension 134 and the second extension 136 may vary as needed.

In one example, as shown in FIG. 6, in one implementation of the present disclosure, the opening coupler 230 may include a first coupler 235 and a second coupler 236. The first extension 134 may be inserted into the first coupler 235. The second coupler 236 may be positioned in rear of the first extension 134. The second extension 136 may be inserted into the second coupler 236.

As described above, the second extension 136 in which the protrusion receiving portion 132 is defined may extend by a larger length than that of the first extension 134. Positions of the first coupler 235 and the second coupler 236 may be adjusted based on the difference between the extending lengths of the first extension 134 and the second extension 136.

The first coupler 235 and the second coupler 236 may be connected to each other and extend along the circumference of the protective casing 200. That is, a portion of the opening coupler 230 may define the first coupler 235, and a portion or an entirety of a remaining portion except for the first coupler 235 may define the second coupler 236.

The first extension 134 may be inserted into the first coupler 235 in the front to rear direction. The second extension 136 may be inserted into the second coupler 236 in the front to rear direction. The second coupler 236 may be positioned in rear of the first coupler 235, such that the second extension 136 extending by a larger length than that of the first extension 134 may be inserted into the second coupler 236.

The second coupler 236 may be connected to the first coupler 235 and may be located in rear of the first coupler 235. The frontward extension 234 of the second coupler 236 and the frontward extension 234 of the first coupler 235 may have the substantially same length. The outward extension 232 of the second coupler 236 may be located in rear of the outward extension 232 of the first coupler 235.

The first coupler 235 may be constructed to overlap with the first extension 134 in the front and rear direction X, while the second coupler 236 may be constructed to overlap with the second extension 136 in the front and rear direction X. That is, the first coupler 235 may be constructed to face the first extension 134, while the second coupler 236 may be constructed to face the second extension 136.

In one implementation of the present disclosure, the second coupler 236 of the opening coupler 230 of the protective casing 200 is located in rear of the first coupler 235 thereof such that the second extension 136 of the opening extension 130 having the protrusion receiving portion 132 defined therein is longer than the first extension 134 thereof. Thus, the opening coupler 230 having a shape corresponding to a shape of the opening extension 130 may be formed, thereby improving coupling stability between the protective casing 200 and the opening extension 130.

In one example, referring to FIG. 7, in one implementation of the present disclosure, a separation opening 237 may be defined in the outward extension 232 of the second coupler 236. The separation opening 237 in rear of the opening coupling protrusion 250 may expose at least a portion of the second extension 136 in a rearward direction.

Specifically, the separation opening 237 may be positioned in rear of the opening coupling protrusion 250. A size of the separation opening 237 in a width direction of the protective casing 200 may be approximately equal to or greater than that of the opening coupling protrusion 250.

The separation opening 237 may have a vertical dimension from the outer face of the opening protection wall 210 equal to or greater than that of the opening coupling protrusion 250. However, the width and the vertical dimension of the separation opening 237 may vary as needed.

The separation opening 237 may be defined by opening at least a portion of the outward extension 232 of the second coupler 236. The separation opening 237 may be opened in the front and rear direction X. The separation opening 237 may include a portion of the outward extension 232 of the second coupler 236 that overlaps with the opening coupling protrusion 250 in the front and rear direction X.

The protective casing 200 needs to be separated from the opening extension 130 of the front panel 110 for replacement, repair or other reasons. In this case, the separation opening 237 may be used so that the opening coupling protrusion 250 is easily separated from the protrusion receiving portion 132 of the opening extension 130.

For example, in order to separate the protective casing 200 from the opening extension 130, the user inserts a hand or tool into the separation opening 237 from a position in rear of the separation opening 237 and spaces the second extension 136 from the outer face of the opening protection wall 210.

The second extension 136 which is spaced apart from the outer face of the opening protection wall 210 may be in a state in which the opening coupling protrusion 250 may be easily separated from the protrusion receiving portion 132. In this state, the user may move the protective casing 200 rearwardly and separate the casing 200 from the front panel 110.

As the separation opening 237 is defined in the outward extension 232 overlapping with the opening coupling protrusion 250 in the front and rear direction X, the user may use the separation opening 237 and then may easily separate a portion of the opening extension 130 where the protrusion receiving portion 132 is formed from the opening protection wall 210.

Further, when a vertical dimension of the separation opening 237 is larger than or equal to a vertical dimension of the opening coupling protrusion 250, the opening extension 130 may be easily pressed to a vertical level at which the protrusion receiving portion 132 deviates upwardly from the opening coupling protrusion 250.

In one example, as shown in FIG. 7, in one implementation of the present disclosure, an extending vertical dimension of the outward extension 232 having the separation opening 237 defined therein of the second coupler 236 may be greater than that of the outward extension 232 of the first coupler 235.

That is, a portion of the outward extension 232 where the separation opening 237 is defined may protrude to a higher level than the other portion thereof may protrude. The outward extension 232 of the second coupler 236 having the larger vertical dimension than that of the outward extension 232 of the first coupler 235 may be formed along an entirety of the second coupler 236 or may be formed only at a portion of the second coupler 236 where the separation opening 237 is defined.

The portion of the outward extension 232 of the second coupler 236 where the separation opening 237 is formed should have a vertical dimension than that of the outward extension 232 of the first coupler 235 to secure an area where the separation opening 237 may be formed.

Accordingly, the outward extension 232 in which the separation opening 237 is formed has a larger vertical dimension than that of a portion of the first coupler 235 or the second coupler 236 where the separation opening 237 is not formed, thereby securing an area in which the separation opening 237 may be formed.

Figure 8:
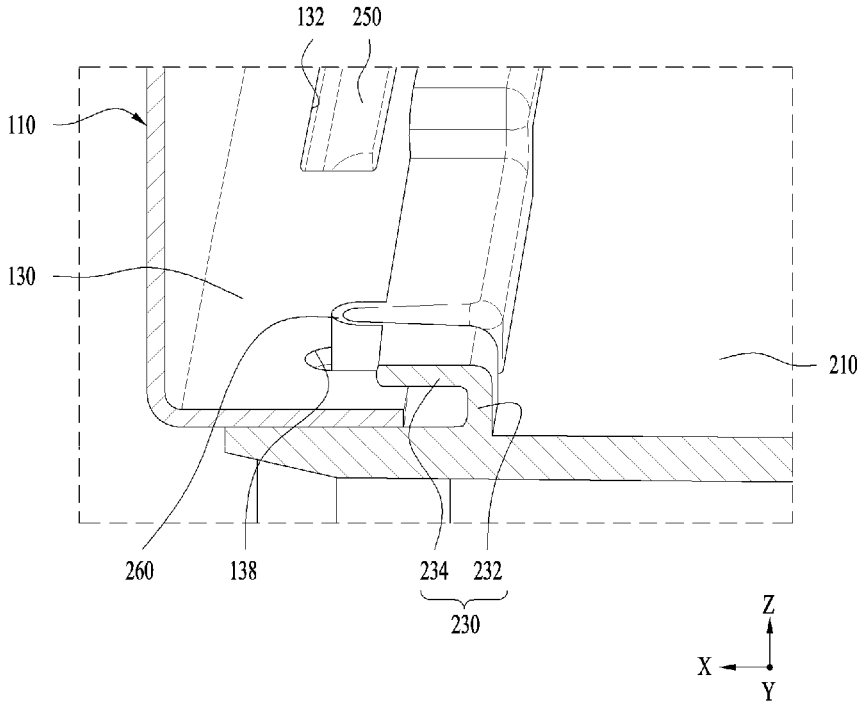
FIG. 8 is a diagram showing a state in which an assembly guide protrusion of the protective casing is inserted into an assembly guide groove of the opening extension in the laundry treating apparatus according to one implementation of the present disclosure.

In one example, FIGS. 5 to 7 show an assembly guide protrusion 260 formed on the opening coupler 230 according to one implementation of the present disclosure. FIG. 8 shows that the assembly guide protrusion 260 of the protective casing 200 is inserted into an assembly guide groove 138 formed in the opening extension 130 according to one implementation of the present disclosure.

Referring to FIGS. 5 to 8, in one implementation of the present disclosure, the opening protection wall 210 further includes the assembly guide protrusion 260 protruding outwards from the outer face thereof. The opening extension 130 may further include the assembly guide groove 138 recessed in a rear end thereof in a front direction. The assembly guide protrusion 260 is inserted into the assembly guide groove 138 in a rear to front direction.

The assembly guide protrusion 260 may protrude outwards from the outer face of the opening protection wall 210. That is, the assembly guide protrusion 260 may extend from the outer face of the opening protection wall 210 as an opposite face of the detergent opening 120 in a direction away from the detergent opening 120.

The assembly guide groove 138 may be defined in a rear end of the opening extension 130 and may be opened rearwards. That is, the assembly guide groove 138 may be opened in a vertical direction Z, and a rear end thereof may be opened rearwards, and may have a shape extending forwards from the rear end.

During a process of coupling the protective casing 200 to the opening extension 130, the assembly guide protrusion 260 may be inserted into the assembly guide groove 138 of the opening extension 130. In one implementation of the present disclosure, the assembly guide protrusion 260 and the assembly guide groove 138 may allow the protective casing 200 to be in a normal state for assembly.

For example, when a cross section of each of the detergent opening 120, the opening extension 130 and the protective casing 200 is formed in a circular or rectangular shape, and even when the protective casing 200 rotates by a certain angle in the outer circumferential direction, it may be difficult for the user to visually identify the rotated state.

Referring to the protective casing 200 in FIG. 7, width directional lengths of top and bottom faces of the protective casing 200 are different from lengths of both side faces in a lateral direction Y. Thus, it is relatively easy for the user to identify an abnormal state in which the protective casing 200 rotates such that the top face of the protective casing 200 is oriented in the lateral direction Y.

However, it may be difficult for the user to easily distinguish an abnormal state that the protective casing 200 of FIG. 7 rotates so that the top face thereof is converted to the bottom face thereof. When the protective casing 200 is coupled to the opening extension 130 in the abnormal state as described above, the coupling may not be possible. Alternatively, even when the coupling is possible, it may not be possible or easy for the protective casing 200 to be coupled to a supply casing 400 which will be described later.

Therefore, in one implementation of the present disclosure, the assembly guide protrusion 260 may be formed on one face of the protective casing 200 so that the normal state for the coupling of the protective casing 200 may be easily identified. The opening extension 130 may have the assembly guide groove 138 defined therein that is positioned in front of the assembly guide protrusion 260 and into which the assembly guide protrusion 260 is inserted.

The assembly guide groove 138 may be defined only in one of the top face, the bottom face and both side faces of the opening protection wall 210. Alternatively, when a plurality of assembly guide grooves 138 are defined, the assembly guide protrusions 260 may be formed on the top face, the bottom face and only one of both opposing side faces of the protective casing 200, so that the abnormal rotated state of the protective casing 200 may be identified.

For example, when the assembly guide protrusion 260 is disposed on the top face of the opening protection wall 210 of the protective casing 200 as shown in FIG. 7, absence of the assembly guide protrusion 260 on the bottom face of the opening protection wall 210 of the protective casing 200 may be advantageous in distinguishing the top and bottom faces of the opening protection wall 210.

Similarly, when the assembly guide protrusion 260 is disposed on one side face in the lateral direction Y of the opening protection wall 210, it may be advantageous that the assembly guide protrusion 260 is not disposed on an opposing side face in the lateral direction Y of the opening protection wall 210.

Alternatively, when the assembly guide protrusions 260 are formed on opposing faces of the opening protection wall 210, respectively, the assembly guide protrusions 260 may be arranged asymmetrically. For example, one assembly guide protrusion 260 may be disposed on a center of the top face of the opening protection wall 210 in the lateral direction Y, while the other assembly guide protrusion 260 may be disposed on the bottom face thereof at a location spaced by a certain distance from the center in the lateral direction Y. Thus, when the protective casing 200 rotates such that the top face is converted to the bottom face, the assembly guide protrusion 260 and the assembly guide groove 138 may not face away each other, so that the abnormal state of the protective casing 200 may be distinguished.

In one example, as shown in FIG. 8, in the laundry treating apparatus 10 according to one implementation of the present disclosure, the assembly guide protrusion 260 may be formed integrally with the opening coupler 230.

That is, the assembly guide protrusion 260 may be constructed to protrude or extend from the opening coupler 230. The opening coupler 230 may act as a portion of the protective casing 200 that is coupled with the opening extension 130. Accordingly, in one implementation of the present disclosure, the assembly guide protrusion 260 is formed on the opening coupler 230 so that positional alignment between the assembly guide protrusion 260 and the assembly guide groove 138 may be naturally identified during the process of combining the protective casing 200 to the opening extension.

In one example, in one implementation of the present disclosure, the assembly guide protrusion 260 may extend forward from the outward extension 232, and a front end of the assembly guide protrusion 260 may be located in front of the frontward extension 234.

The assembly guide protrusion 260 may be constructed to protrude forward from the outward extension 232. Alternatively, a portion of the outward extension 232 may have a curved shape protruding forwards from a rest portion thereof to form the assembly guide protrusion 260.

The assembly guide protrusion 260 extending forward from the outward extension 232 may be connected to the outer face of the opening protection wall 210, and may also be connected to the frontward extension 234. That is, the assembly guide protrusion 260 extending from the outward extension 232 may be constructed to protrude in a direction away from the opening protection wall 210.

Further, in one implementation of the present disclosure, the assembly guide protrusion 260 may be disposed between the opening protection wall 210 and the frontward extension 234, or may have a shape connected to the frontward extension 234. For example, as shown in FIG. 8, a portion of the outward extension 232 may have a curved shape protruding forwards to form the assembly guide protrusion 260. The assembly guide protrusion 260 and the frontward extension 234 may be connected to each other in a lateral direction Y, and the frontward extension 234 may be omitted on the top face of the assembly guide protrusion 260.

Further, the front end of the assembly guide protrusion 260 may be located in front of the frontward extension 234. That is, the assembly guide protrusion 260 is first inserted into the assembly guide groove 138 before the opening extension 130 is inserted into the opening coupler 230. Accordingly, before the opening extension 130 is inserted into the opening coupler 230, it may be checked whether the protective casing 200 is positioned in a normal state.

Figure 9:
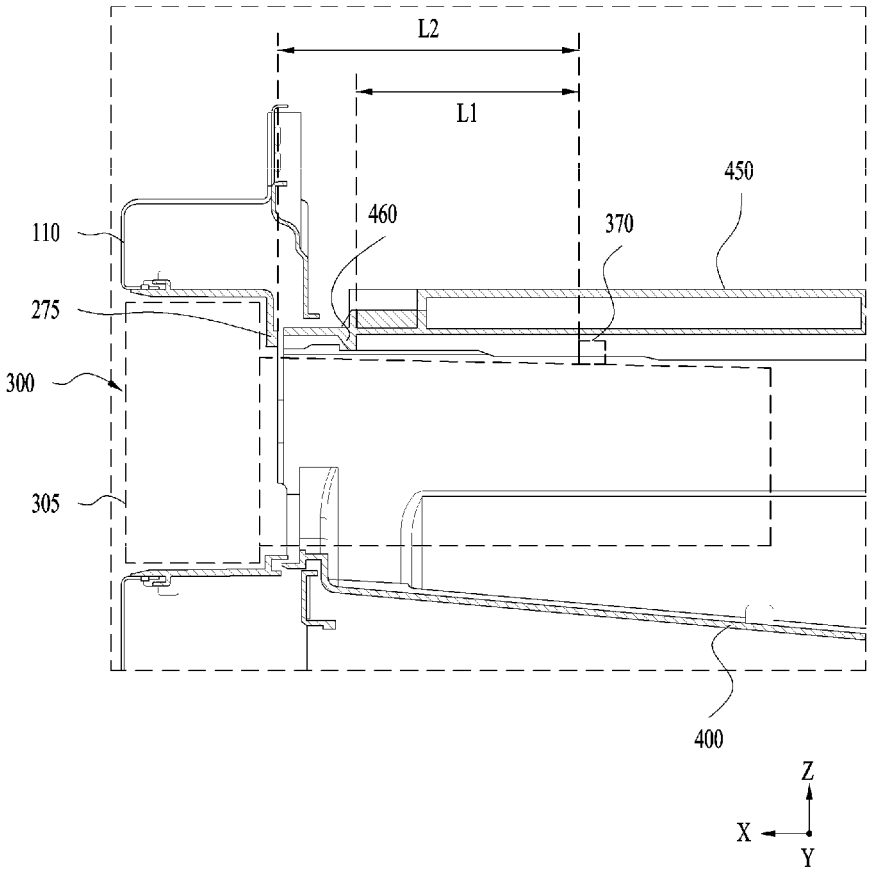
FIG. 9 is a side cross-sectional view of an interior of a cabinet into which a detergent storage unit is inserted in the laundry treating apparatus according to one implementation of the present disclosure.

In one example, FIG. 9 schematically shows a side cross-section view of a state in which the protective casing 200 is coupled to the opening extension 130, and the detergent storage unit 300 has retracted into the cabinet 100 through the detergent opening 120.

Referring to FIG. 9, in the laundry treating apparatus 10 according to one implementation of the present disclosure, the opening protection wall 210 extends so that the rear end thereof is located in rear of the opening extension 130, and supports at least a portion of the detergent storage unit 300 retracting into the cabinet 100.

Specifically, as described above, the front end of the opening protection wall 210 is located in front of the front end of the frontward extension 234 to increase a protected area of the opening extension 130. Furthermore, the opening protection wall 210 extends so that the rear end thereof is located in rear of the opening extension 130 to secure the support space for the detergent storage unit 300.

That is, the detergent storage unit 300 is supported while at least a portion thereof is surrounded with the protective casing 200, that is, the opening protection wall 210. The opening protection wall 210 extends such that the rear end of the opening protection wall 210 is located in rear of the opening extension 130, thus increasing a space surrounding and supporting the detergent storage unit 300.

That is, in one implementation of the present disclosure, the protective casing 200 may be constructed to surround the detergent opening 120. The detergent storage unit 300 may pass through the protective casing 200 and at least a portion thereof may be accommodated in the protective casing 200.

Figure 10:
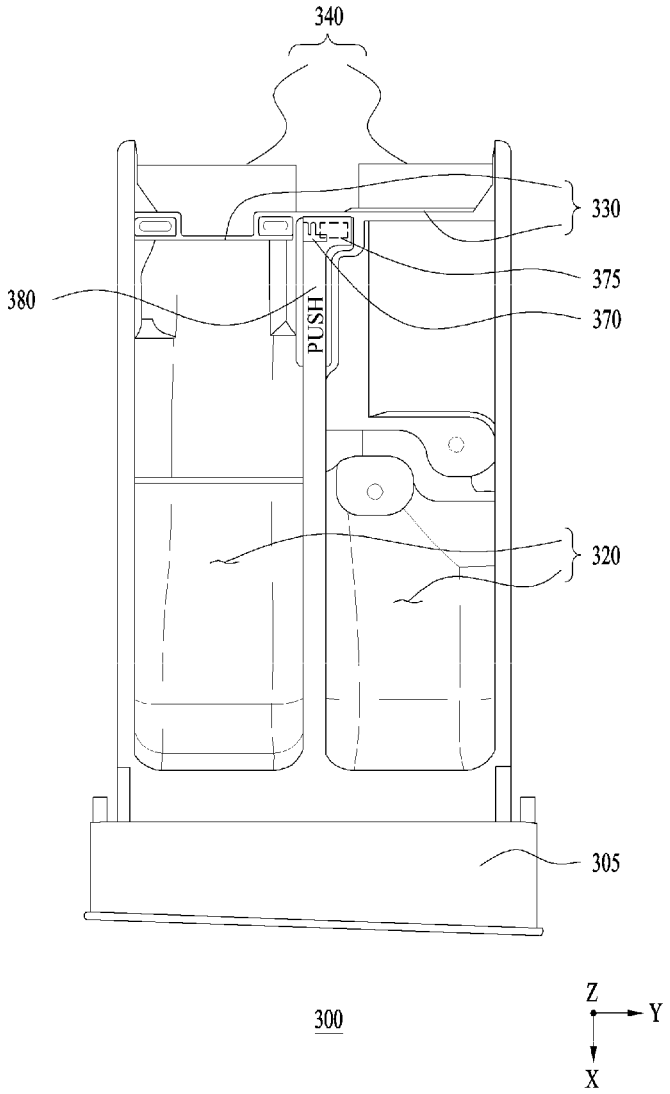
FIG. 10 is a diagram showing the detergent storage unit retracting into the detergent opening in the laundry treating apparatus according to one implementation of the present disclosure.

In one example, FIG. 10 shows a top view of the detergent storage unit 300 that constitutes a portion of the detergent supply. Referring to FIGS. 9 and 10, in one implementation of the present disclosure, the detergent storage unit 300 has a handle 305 at a front end thereof. The opening protection wall 210 extends so that the rear end thereof is located in rear of the opening extension 130 so as to surround and support the handle 305.

The handle 305 disposed at the front end of the detergent storage unit 300 may be located on the protective casing 200 and the detergent opening 120 when the detergent storage unit 300 is housed inside the cabinet 100, so that a front face of the handle 305 is exposed to the outside of the cabinet 100.

A gripping groove that may be held by the user may be formed in a front face of the handle 305. Accordingly, the user may extend or retract the detergent storage unit 300 from or into the cabinet 100 while holding the handle 305 of the detergent storage unit 300.

Further, the handle 305 may be disposed at the front end of the detergent storage unit 300. Thus, the handle 305 may be located inside the protective casing 200 extending in the front and rear direction X and having the rear end located in rear of the opening extension 130.

That is, the handle 305 may be surrounded with the opening protection wall 210 of the protective casing 200 and supported by the opening protection wall 210. A front view of a cross-sectional shape of the handle 305 may correspond to that of a cross-sectional shape of the opening protection wall 210.

In one example, FIG. 7 shows a rear wall 270 of the protective casing 200 according to one implementation of the present disclosure. FIG. 9 shows a cross section of the rear wall 270. Referring to FIGS. 7 and 9, in one implementation of the present disclosure, the protective casing 200 may further include the rear wall 270.

The rear wall 270 may be located in rear of the front panel 110 or the opening extension 130 and may be connected to the opening protection wall 210, and may have a through-opening 272 defined therein which the detergent storage unit 300 passes through. A portion of the detergent storage unit 300 retracting inside the cabinet 100 may be located in rear of the rear wall 270, and a rest thereof may be supported forwards by the rear wall 270, such that a retracting distance thereof may be limited.

The rear wall 270 may extend in a parallel manner to the front panel 110 of the cabinet 100. The rear wall 270 may extend along a boundary between an interior of the protective casing 200 surrounded with the opening protection wall 210 and an interior of the cabinet 100.

The protective casing 200 may be constructed such that the rear end of the opening protection wall 210 is located in rear of the opening extension 130. The rear wall 270 may be connected to the rear end of the opening protection wall 210. That is, the rear wall 270 may constitute a rear face of the protective casing 200.

The through-opening 272 may be defined in the rear wall 270. the detergent storage unit 300 passes through the through-opening 272. The through-opening 272 may be constructed to have a cross-sectional shape corresponding to that of the detergent storage unit 300, such that the detergent storage unit 300 may stably retract into the cabinet 100 through the through-opening 272.

In one example, as described above, the handle 305 of the detergent storage unit 300 may be accommodated inside the protective casing 200. A rest portion of the detergent storage unit 300 except the handle 305 may retract into the cabinet 100 through the through-opening 272.

The detergent storage unit 300 may have a detergent receiving space 320 in which detergent is stored and received. The space 320 may be formed in rear of the handle 305. The storage unit 300 may include a detergent storage unit container in which detergent is stored and/or a detergent cup having an open top face and storing therein detergent. The storage unit 300 may include a storage frame in which the detergent receiving space 320, the detergent storage unit container and/or detergent cup are arranged are disposed.

FIG. 10 shows the detergent storage unit 300 according to one implementation of the present disclosure. In FIG. 10, the storage unit 300 includes the storage frame that is coupled with the handle 305 and is disposed in rear of the handle 305. The storage frame has the detergent receiving space 320 defined therein in which detergent is stored. The detergent cup or the detergent storage unit container may be inserted into inner spaces of the storage frame.

As shown in FIG. 10, in one implementation of the present disclosure, the handle 305 may have a front cross-sectional area different from that of the storage frame in rear of the handle 305. For example, the handle 305 may be constructed to have a larger front cross-sectional area than that of the storage frame in rear of the handle 305.

In one example, as described above, a portion of the detergent storage unit 300 such as the handle 305 may be located inside the protective casing 200, while a rest portion thereof such as the storage frame, etc. may be accommodated inside the cabinet 100.

In other words, a portion of the detergent storage unit 300 retracts into the cabinet 100 and a rest portion thereof is located inside the protective casing 200. A retracting distance of this detergent storage unit 300 may be limited by the rear wall 270.

For example, the rear wall 270 may restrict rearward movement of a protruding portion of the detergent storage unit 300. Accordingly, the portion of the detergent storage unit 300 comes into contact with the rear wall 270 and is supported forwards by the rear wall, such that the rearward movement thereof is prohibited.

Eventually, the portion of the detergent storage unit 300 may be supported by the rear wall 270 and may be disposed inside the protective casing 200. Thus, the retracting distance thereof to the inside of the cabinet 100 may be limited by the rear wall 270.

In one example, in one implementation of the present disclosure, the handle 305 of the detergent storage unit 300 may be supported forwards by the rear wall 270, while a rest portion thereof may retract into the cabinet 100 through the through-opening 272.

As described above, the handle 305 has a larger cross-sectional area than that of the storage frame in rear of the handle. Thus, in the process of retracting the detergent storage unit 300 into the cabinet 100 through the protective casing 200, the handle 305 may be supported forwards by the rear wall 270.

In FIG. 9, according to one implementation of the present disclosure, a portion of the detergent storage unit 300, that is, the storage frame thereof passes through the through-opening 272 and has retracted into the cabinet 100, and a rest portion thereof, that is, the handle 305 is supported forwards by rear wall 270, such that the retracting distance of the storage unit 300 into the cabinet 100 is limited.

In one implementation of the present disclosure, due to the rear wall 270 of the protective casing 200, as a portion of the detergent storage unit 300 is retracting into the cabinet 100, the handle 305 may be stably supported by the rear wall 270, thereby improving structural stability, and effectively fixing the detergent storage unit 300.

The handle 305 of the detergent storage unit 300 is surrounded with the opening protection wall 210 of the protective casing 200, and the retracting distance of the storage unit 300 is limited by the rear wall 270. The storage frame passes through the through-opening 272 of the rear wall 270 and may retract into the cabinet 100.

Therefore, in one implementation of the present disclosure, an opening stopper 275 that limits the extending distance of the detergent storage unit 300 may be formed on the rear wall 270 of the protective casing 200. That is, the opening stopper 275 may be formed on the rear wall 270 through which the storage frame passes, instead of the opening protection wall 210 that may support the handle 305, thereby effectively limiting the extending distance of the detergent storage unit 300 without interfering with the receiving of the handle 305 in the protective casing 200.

In one example, as described above, the detergent supply for supplying the detergent to the drum 14 may be disposed inside the cabinet 100. The detergent storage unit 300 retracting into the cabinet 100 may define a portion of the detergent supply. The detergent supply may further include the supply casing 400 and the dispenser 450.

As shown in FIG. 9, the laundry treating apparatus 10 according to one implementation of the present disclosure may further include the supply casing 400. The supply casing 400 may be disposed inside the cabinet 100, and the front end of the casing 400 may be coupled to the protective casing 200. The casing 400 may accommodate therein the detergent storage unit 300 that has retracted into the cabinet 100.

The supply casing 400 may be located in rear of the protective casing 200, and may accommodate therein the detergent storage unit 300 that has retracted into the cabinet 100. A front end of the supply casing 400 facing towards the protective casing 200 may be coupled to the protective casing 200.

In other words, the front panel 110, the protective casing 200 and the supply casing 400 may have coupling relationships therebetween. As a result, a stable structure may be realized, and the detergent storage unit 300 retracting into the cabinet 100 may be effectively accommodated in the supply casing 400.

In one example, the front end of the supply casing 400 may be coupled to the rear wall 270 of the protective casing 200. Specifically, the rear wall 270 of the protective casing 200 may be constructed to extend along a boundary between the interior of the protective casing 200 and the interior of the cabinet 100. The front end of the supply casing 400 may face toward the rear wall 270.

Accordingly, in one implementation of the present disclosure, the front end of the supply casing 400 may be coupled to the rear wall 270 of the protective casing 200. A coupling scheme between the supply casing 400 and the rear wall 270 may vary.

For example, a through-member such as a screw or a rivet may pass through both of the rear wall 270 and the supply casing 400. Alternatively, a fitting-type fastener such as a hook may be disposed on the rear wall 270 or the supply casing 400.

FIG. 7 shows that a through coupler is disposed on each of both sides of the rear wall 270 in the lateral direction Y and the through member passes through the through coupler, according to one implementation of the present disclosure. The through member passing through the through coupler may be coupled to the supply casing 400.

In one example, as shown in FIG. 9, the laundry treating apparatus 10 according to one implementation of the present disclosure may further include the dispenser 450. The dispenser 450 may be disposed inside the cabinet 100 and may supply washing-water to the detergent storage unit 300 that has retracted into the cabinet 100. The dispenser 450 may be placed above the supply casing 400.

As described above, the dispenser 450 may define a portion of the detergent supply, and may be disposed inside the cabinet 100 and may be constructed to supply the washing-water to the detergent storage unit 300.

As for the detergent supply, the detergent storage unit 300 retracting into the cabinet 100 is accommodated in the supply casing 400. The dispenser 450 supplies washing-water to the detergent storage unit 300. The detergent stored inside the detergent storage unit 300 is discharged into the supply casing 400 together with the washing-water. The supply casing 400 may deliver the washing-water and the detergent discharged from the detergent storage unit 300 to the drum 14 inside cabinet 100.

The dispenser 450 may be placed above the supply casing 400, and may be coupled to supply casing 400. The dispenser 450 may be manufactured separately from the supply casing 400 or the top face of the supply casing 400 may define the dispenser 450.

The dispenser 450 may be placed above the supply casing 400 and may have organic coupling relationships with the supply casing 400, the detergent storage unit 300 and the protective casing 200. That is, the detergent storage unit 300 retracted through the protective casing 200 may be accommodated inside the supply casing 400 that is coupled to the protective casing 200 and is disposed in rear of the protective casing 200. Washing-water from the dispenser 450 supported upwards by the supply casing 400 may be supplied to the detergent storage unit 300.

In one example, referring to FIG. 10, in one implementation of the present disclosure, the detergent storage unit 300 has the detergent receiving space 320 defined therein in which detergent is accommodated. A detergent outlet 330 may be defined in a rear face of the storage unit 300 and communicate with the detergent receiving space 320. The detergent may be discharged through the detergent outlet 330 into the drum. A rear end of the bottom face 340 of the detergent storage unit 300 is located in rear of the rear face thereof to prevent detergent leakage.

As described above, the detergent storage unit 300 may have the detergent receiving space 320 defined in the storage frame that has retracted into the cabinet 100. The detergent outlet 330 may be defined in the rear face of the detergent storage unit 300 to discharge the detergent contained in the detergent receiving space 320 into the drum.

That is, the detergent stored in the detergent receiving space 320 may be discharged to the outside of the detergent storage unit 300 through the detergent outlet 330 which is defined in the rear face of the detergent storage unit 300 and communicates with the detergent receiving space 320.

In one example, the bottom face 340 of the detergent storage unit 300 may extend so that the rear end of the bottom face 340 is located in rear of the rear face. That is, the detergent discharged through the detergent outlet 330 defined in the rear face of the detergent storage unit 300 flows on the rear end of the bottom face 340 and may be discharged to the outside of the detergent storage unit 300.

A portion of the detergent stored in the detergent receiving space 320 of the detergent storage unit 300 may be unintentionally discharged through the detergent outlet 330, or the detergent remaining in a flow path of the detergent may be discharged through the detergent outlet 330 during the transfer of the detergent storage unit 300.

In this case, for example, when the detergent storage unit 300 extends from the cabinet 100, the detergent or the washing-water may leak from the detergent outlet to the opening protection wall 210 of the protective casing 200.

As described above, the detergent and the washing-water leaking from the detergent storage unit 300 may act adversely, for example, may induce corrosion of the opening extension 130 or deform the opening protection wall 210.

Therefore, in one implementation of the present disclosure, the bottom face 340 of the detergent storage unit 300 extends such that the rear end thereof is located in rear of the rear face of the storage unit 300 in which the detergent outlet 330 is formed. Thus, even when the detergent or the washing-water accidentally leaks from the detergent outlet 330, the leakage thereof into the opening extension 130 or the opening protection wall 210 may be prevented or suppressed because the detergent or the washing-water remains on the rear end of the bottom face 340.

In one example, in one implementation of the present disclosure, the protective casing 200 may include an opening stopper 275. The detergent storage unit 300 may include a stopper protrusion 370.

FIG. 7 shows the opening stopper 275 disposed on the protective casing 200. FIG. 9 schematically shows a positional relationship between the opening stopper 275 and the stopper protrusion 370. FIG. 10 shows a top view of the stopper protrusion 370 of the detergent storage unit 300.

The opening stopper 275 may be disposed on the protective casing 200 and be constructed to protrude toward the detergent storage unit 300. Further, the stopper protrusion 370 of the detergent storage unit 300 may be constructed to overlap at least a portion of the opening stopper 275 in the front and rear direction X.

That is, the stopper protrusion 370 may be constructed to come into contact with the opening stopper 275 when the storage unit 300 is moving in the front and rear direction X. While the detergent storage unit 300 has retracted into the cabinet 100, the stopper protrusion 370 may be spaced rearwardly away from the opening stopper 275.

A shape or a location of the opening stopper 275 may vary. For example, the opening stopper 275 may protrude from the inner face of the opening protection wall 210 or may protrude from an inner face of the through-opening 272 defined in the rear wall 270 as described later.

Further, a shape and a location of the stopper protrusion 370 may vary. For example, the stopper protrusion 370 may be disposed on the storage frame of detergent storage unit 300, and may protrude upward from detergent storage unit 300 as described below.

Figure 11:
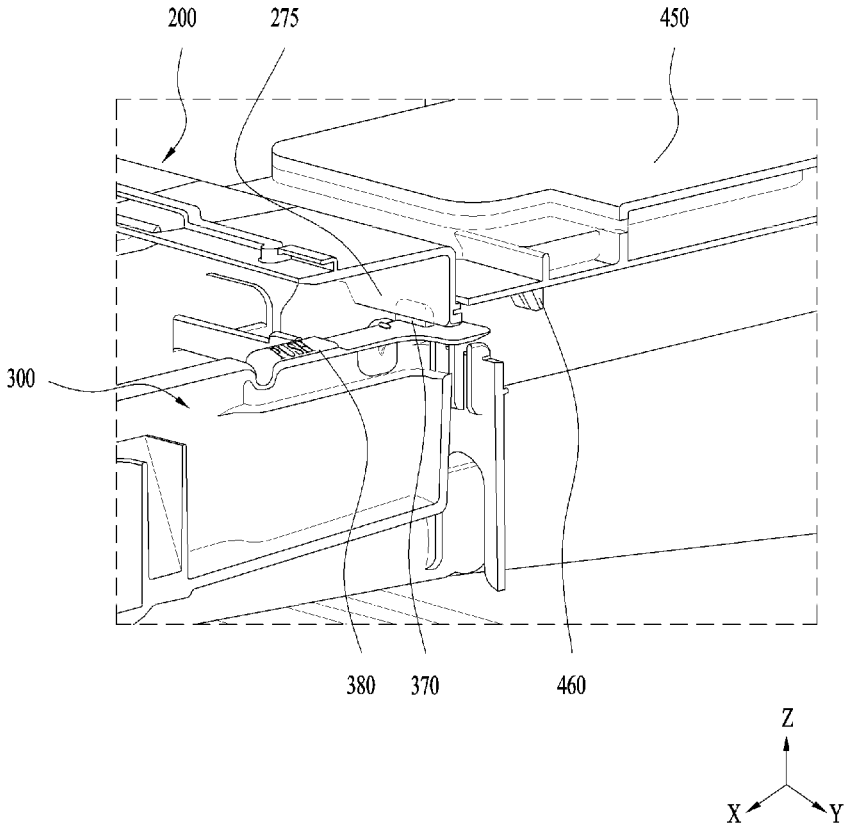
FIG. 11 is a diagram showing a state in which a stopper protrusion of the detergent storage unit contacts an opening stopper in the laundry treating apparatus according to one implementation of the present disclosure.

In one example, FIG. 11 shows a state in which the detergent storage unit 300 retracted into the cabinet 100 extends by a predefined extending distance to be described later, and the stopper protrusion 370 and the opening stopper are in contact with each other, according to one implementation of the present disclosure.

Referring to FIG. 11, in one implementation of the present disclosure, in the process of extending the detergent storage unit 300 from the cabinet 100, the stopper protrusion 370 may contact the opening stopper 275 such that an extending distance of the storage unit 300 may be limited.

In one implementation of the present disclosure, the detergent storage unit 300 may eventually be received and utilized in the supply casing 400. Accordingly, the detergent storage unit 300 may extend outside the cabinet 100 by a predetermined extending distance and may be used by the user.

That is, in one implementation of the present disclosure, the predefined extending distance of the detergent storage unit 300 may be determined by adjusting a spacing between the stopper protrusion 370 of the detergent storage unit 300 retracting into the cabinet 100 and the opening stopper 275 of the protective casing 200.

As used herein, the term "the predefined extending distance" refers to an extending distance by which the detergent storage unit 300 retracting into the cabinet 100 may extend by a design. Referring to FIG. 9, the predefined extending distance may correspond to the spacing between the stopper protrusion 370 and the opening stopper 275 or an inner stopper 460 which will be described later. While the detergent storage unit 300 has extended by the predefined extending distance, the detergent receiving space 320 may be exposed to the outside, so that a process in which the user stores the detergent in the detergent storage unit 300 is not inconvenient.

In one implementation of the present disclosure, the protective casing 200 has the opening stopper 275 that contacts the stopper protrusion 370 of the detergent storage unit 300 and thus restricts the forward movement of the stopper protrusion 370. Thus, a sufficient spacing between the stopper protrusion 370 and the opening stopper 275 may be secured. Further, the sufficient predefined extending distance of the detergent storage unit 300 may be secured so that the detergent receiving space 320 may be exposed to the outside.

In one example, in one implementation of the present disclosure, the opening stopper 275 may protrude from an inner circumferential face surrounding the through-opening 272 of the rear wall 270 toward the through-opening 272.

Referring to FIG. 7, in one implementation of the present disclosure, the opening stopper 275 may be disposed on the rear wall 270. More specifically, the opening stopper 275 may protrude from the inner face or the inner circumferential face surrounding the through-opening 272 of the rear wall 270 toward the through-opening 272.

That is, the opening stopper 275 may be constructed to screen a portion of the through-opening 272 in the front and rear direction X. A specific protrusion direction or shape of the opening stopper 275 may be variously determined as needed in relation to the stopper protrusion 370, and the like.

FIG. 11 shows a state in which the opening stopper 275 protruding from the rear wall 270 of the protective casing 200 and the stopper protrusion 370 of the detergent storage unit 300 contact each other, according to one implementation of the present disclosure.

In one implementation of the present disclosure, the opening stopper 275 may protrude from the rear wall 270 in which the through-opening 272 is formed. This may be advantageous for the opening stopper 275 to be positioned to contact the stopper protrusion 370 during the retracting and extending process of the detergent storage unit 300.

In one example, as shown in FIGS. 7 and 11, in one implementation of the present disclosure, the opening stopper 275 may be constructed to extend or protrude downward from the protective casing 200. As shown in FIGS. 9 and 10, in one implementation of the present disclosure, the stopper protrusion 370 may be constructed to extend or protrude upward from the detergent storage unit 300.

The opening stopper 275 disposed on the rear wall 270 of the protective casing 200 may be located above the through-opening 272. The stopper protrusion 370 may protrude upward from the top face of the detergent storage unit 300. The stopper protrusion 370 may be disposed on the storage frame located in rear of the handle 305 of the detergent storage unit 300.

In one implementation of the present disclosure, the opening stopper 275 is positioned above the detergent storage unit 300, and the stopper protrusion 370 protrudes upwards from a top of the storage unit 300. Thus, the predefined extending distance may be defined by the opening stopper 275 and the stopper protrusion 370 while unnecessary structural interference along the movement of the detergent storage unit 300 is minimized.

As shown in FIG. 10, in one implementation of the present disclosure, the stopper protrusion 370 may be located at the center of detergent storage unit 300 in the lateral direction Y. The opening stopper 275 may be located at a center of a top of the through-opening 272 defined therein the rear wall 270 in a positional corresponding manner with the stopper protrusion 370.

A position of one end of the detergent storage unit 300 is fixed while the other end thereof has the stopper protrusion 370. The other end further has a stopper bar 380 whose a position is variable along a protruding direction of the stopper protrusion 370.

In one example, as shown in FIGS. 9 and 11, in one implementation of the present disclosure, the detergent storage unit 300 may further include the stopper bar 380. A position of one end of the stopper bar 380 is fixed, and the other end thereof has the stopper protrusion 370. A position of the other end thereof may vary along the protruding direction of the stopper protrusion 370.

Specifically, one end of the stopper bar 380 may be fixed to the detergent storage unit 300. The stopper bar 380 may be manufactured separately from the detergent storage unit 300 and nay be coupled to the detergent storage unit 300, or may be integrally formed with the detergent storage unit 300, for example, the storage frame.

In one example, one end of the stopper bar 380 may be fixed to the detergent storage unit 300, and the other end thereof may define a free end whose a position is variable around one end. That is, one end of the stopper bar 380 may define a fixed end fixed to the detergent storage unit 300, and the other end thereof may define a free end separated from the detergent storage unit 300.

The stopper bar 380 may have the stopper protrusion 370 at the other end of the stopper bar 380. That is, the stopper protrusion 370 may be disposed on the other end thereof and a position thereof may vary together with the other end thereof. The change in the position of the other end thereof may be achieved via deformation of the stopper bar 380 resulting from pressing one end.

Further, the stopper protrusion 370 may protrude upward from the other end of stopper bar 380. The other end of the stopper bar 380 may move approximately along the vertical Z direction when one end thereof is pressed. That is, the other end of the stopper bar 380 defining the free end may vary in position along a direction parallel to the protruding direction of the stopper.

Accordingly, when one end of the stopper bar 380 is pressed downward, the stopper protrusion 370 may move downward together with the other end of the stopper bar 380. When stopper protrusion 370 moves downward and reaches a level lower than a level of the opening stopper 275, the detergent storage unit 300 may extend out of the cabinet 100 through the detergent opening 120 while the extending distance is not limited by the opening stopper 275.

In other words, the user may selectively press one end of the stopper bar 380 disposed on the detergent storage unit 300 as needed and thus selectively and completely extend the detergent storage unit 300 from the cabinet 100.

A direction of extension of the stopper bar 380 may be varied as required. For example, the stopper bar 380 may be disposed on a side face of the detergent storage unit 300 and extend in the vertical direction Z or the front and rear direction X, or may be disposed on the top face of the detergent storage unit 300 and extend in the front and rear direction X or the lateral direction Y.

In one example, in one implementation of the present disclosure, the stopper bar 380 extends along the front and rear direction X of the detergent storage unit 300. The front end thereof is fixed to the detergent storage unit 300. The stopper protrusion 370 is disposed on the rear end thereof. While the stopper protrusion 370 is in contact with the opening stopper 275, the front end thereof may be exposed to the outside of the cabinet 100.

As described above, the change in the position of the other end of the stopper bar 380 may be caused by pressing one end thereof. One end thereof may be selectively pressed by the user. In one implementation of the present disclosure, the stopper bar 380 extends along the front and rear direction X from the top face of the detergent storage unit 300 so that one end of the stopper bar 380 is easily pressed by the user. One end thereof may define a front end.

In one implementation of the present disclosure, the stopper bar 380 extends in the front and rear direction X, and the front end thereof is fixed to the detergent storage unit 300. The stopper protrusion 370 is disposed on the rear end thereof. Thus, while the stopper protrusion 370 comes into contact with the opening stopper 275 and thus the detergent storage unit 300 extends by the predefined extending distance from the cabinet, the front end thereof may be exposed to the outside of the cabinet 100 such that the user may easily press the front end.

In other words, in one implementation of the present disclosure, the front end of the stopper bar 380 may be fixed to the detergent storage unit 300, and the front end of the stopper bar may be exposed to the outside of the cabinet 100 while the stopper protrusion 370 is in contact with the opening stopper 275.

FIG. 11 shows a state in which the front end of the stopper bar 380 is exposed to the outside of the cabinet 100 while the forward movement of the stopper protrusion 370 is restricted by the opening stopper 275, according to one implementation of the present disclosure.

The front end of the stopper bar 380 may be exposed to the outside even when the storage unit 300 is located inside the protective casing 200 as shown in FIG. 11. For example, a cross-sectional area of the protective casing 200 may correspond to that of the handle 305 of the detergent storage unit 300. The storage frame disposed in rear of the handle 305 may have a smaller cross-sectional area than that of the handle 305. Considering the cross-sectional area of the protective casing 200, the front end of the stopper bar 380 disposed on the top face of the storage frame may be exposed to the outside even when the storage unit 300 is received in the protective casing 200.

Figure 12:
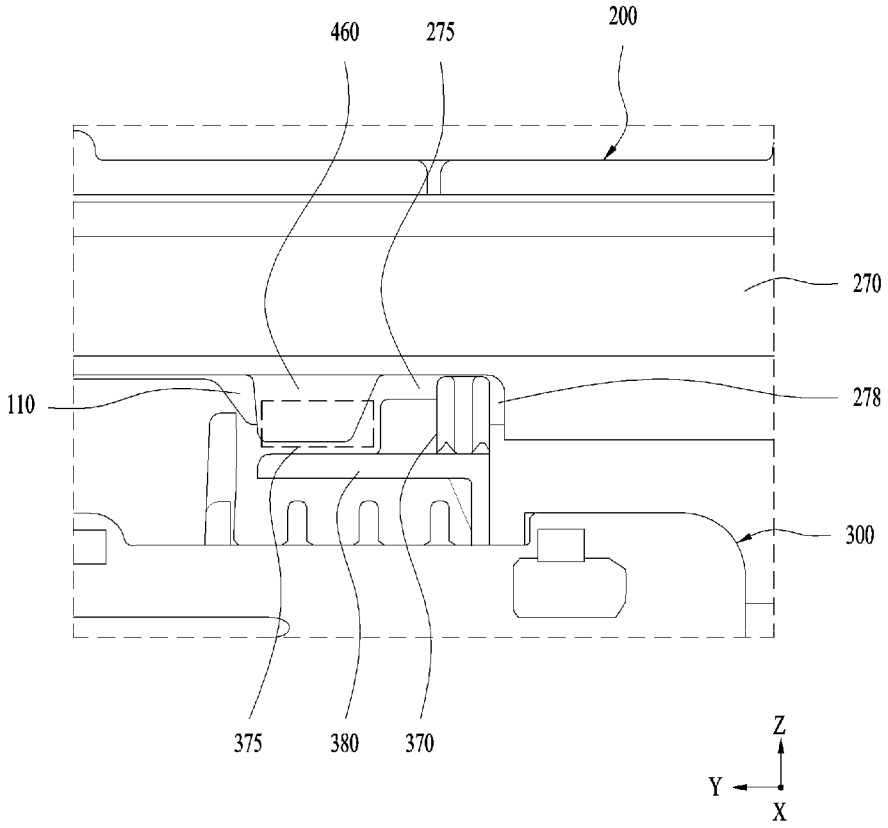
FIG. 12 is a rear view showing the stopper protrusion having a bypass region in the laundry treating apparatus according to one implementation of the present disclosure.

In one example, FIGS. 9 and 11 show the inner stopper 460 located inside the cabinet 100. FIG. 12 shows a rear view of the inner stopper 460.

Referring to FIGS. 9 and 11, one implementation of the present disclosure may further include an inner stopper 460. The inner stopper 460 may be disposed inside the cabinet 100, and may protrude toward the detergent storage unit 300 that has retracted into the cabinet 100.

The inner stopper 460 may be constructed to overlap the stopper protrusion 370 of the detergent storage unit 300 along the front and rear direction X, as in the opening stopper 275. That is, the stopper protrusion 370 may be in contact with the inner stopper 460 and/or the opening stopper 275 during the extending process of the detergent storage unit 300, so that the extension of the detergent storage unit 300 may be limited.

The inner stopper 460, the opening stopper 275 and the stopper protrusion 370 may be arranged in the front and rear direction X. That is, the opening stopper 275, the inner stopper 460, and the stopper protrusion 370 may be arranged approximately in a line along the front and rear direction X.

Like the opening stopper 275, the inner stopper 460 may limit the extending distance of the detergent storage unit 300 while contacting the stopper protrusion 370. Accordingly, in the laundry treating apparatus 10 according to one implementation of the present disclosure, the extending distance of the detergent storage unit 300 may be adjusted in a stepwise manner.

In one example, the inner stopper 460 may be located in rear of the opening stopper 275, and may be located in front of the stopper protrusion 370 of the detergent storage unit 300 that has retracted into the cabinet 100.

Accordingly, when the stopper protrusion 370 sequentially contacts the inner stopper 460 and the opening stopper 275, the stopper protrusion 370 first contacts the inner stopper 460 such that the extending distance of the detergent storage unit 300 may be first limited. Then, the stopper protrusion 370 passes by the inner stopper 460 when the user pressurizes the front end of the stopper bar 380. Thus, the stopper protrusion 370 contacts the opening stopper 275 such that the extending distance of the detergent storage unit 300 may be second limited.

Referring to FIG. 9, in one implementation of the present disclosure, when the stopper protrusion 370 contacts the inner stopper 460 and the opening stopper 275 sequentially, a distance L1 between the inner stopper 460 and the stopper protrusion 370 of the detergent storage unit 300 completely retracting into the cabinet 100 may correspond to a first predefined extending distance. A distance L2 between the stopper protrusion 370 and the opening stopper 275 may correspond to a second predefined extending distance.

The first predefined extending distance may be set to be larger than the second predefined extending distance. The L1 and L2 may be determined by controlling the positions of the opening stopper 275, the inner stopper 460 and the stopper protrusion 370.

In one example, the inner stopper 460 may be disposed on the dispenser 450 as described above. Specifically, dispenser 450 may be located above the supply casing 400 that accommodates the detergent storage unit 300. The inner stopper 460 may protrude downward from a bottom face of the dispenser 450.

That is, the opening stopper 275 and the inner stopper 460 may be spaced apart from each other, and may be located in front of the stopper protrusion 370, and may protrude downwards. The stopper protrusion 370 may protrude upward and may be disposed in rear of the opening stopper 275 and the inner stopper 460 and overlap with the opening stopper 275 and the inner stopper 460 in the front and rear direction X.

As described above, the stopper protrusion 370 may protrude upward from the detergent storage unit 300 and contact at least one of the opening stopper 275 and the inner stopper 460 during the extending process of the detergent storage unit 300.

For example, the stopper protrusion 370 bypasses the inner stopper 460 during the extending process of the detergent storage unit 300 and contacts opening stopper 275. Alternatively, the stopper protrusion 370 contacts the inner stopper 460, and then bypasses the opening stopper 27, Alternatively, the stopper protrusion 370 may contact sequentially the inner stopper 460 and the opening stopper 275.

In the laundry treating apparatus 10 according to one implementation of the present disclosure, a correlation between the opening stopper 275, the inner stopper 460 and the stopper protrusion 370 may be described as follows.

The inner stopper 460 may be disposed inside the cabinet 100, and may protrude toward the detergent storage unit 300. The opening stopper 275 may be located in front of the inner stopper 460 and may protrude toward the detergent storage unit 300.

The stopper protrusion 370 may be disposed on the detergent storage unit 300. The stopper protrusion 370 may be located in rear of the inner stopper 460 while the detergent storage unit 300 has retracted into the cabinet 100. During the extending process of the detergent storage unit 300, the stopper protrusion 370 may contact at least one of the inner stopper 460 and the opening stopper 275 to limit the extending distance of the detergent storage unit 300.

Further, in one implementation of the present disclosure, the protective casing 200 is coupled to the inner face of the front panel 110. The detergent storage unit 300 passes through the protective casing 200. The protective casing 200 includes the opening stopper 275.

Further, in one implementation of the present disclosure, the dispenser 450 may be located in rear of the protective casing 200. The dispenser 450 may supply washing-water to the detergent storage unit 300. The dispenser 450 may include the inner stopper 460.

Figure 13:
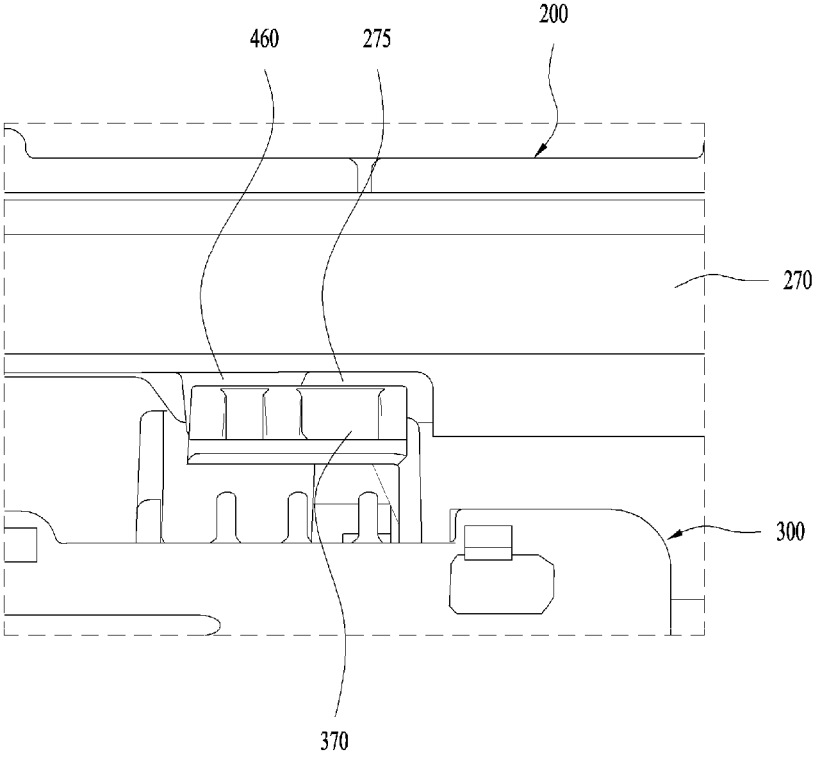
FIG. 13 is a rear view showing the stopper protrusion from which the bypass region is removed in the laundry treating apparatus according to one implementation of the present disclosure.

In one example, FIG. 12 shows a rear view of the stopper protrusion 370 having a bypass region 375 defined therein to bypass the inner stopper 460 in the lateral direction Y. FIG. 13 shows a rear view of the stopper protrusion 370 which is constructed to overlap at least partially the inner stopper 460, and the opening stopper 275 in the front and rear direction X.

Referring to FIG. 12, in one implementation of the present disclosure, the stopper protrusion 370 is constructed to overlap with the opening stopper 275 but not to overlap with the inner stopper 460 along the front and rear direction X. Thus, in the process of extending the detergent storage unit 300, the stopper protrusion 370 may bypass the inner stopper 460 and may come into contact with the opening stopper 275.

That is, in one implementation of the present disclosure, the stopper protrusion 370 may be constructed not to contact the inner stopper 460, and may be constructed to contact the opening stopper 275 in the front and rear direction X.

The bypass region 375 may be embodied as an empty space. The bypass region 375 may be located in rear of the inner stopper 460, and may be located on a side of the stopper protrusion 370. The bypass region 375 may have a cross-sectional area greater than that of the inner stopper 460 in a front view.

That is, in the process of extending the detergent storage unit 300, the inner stopper 460 may bypass the stopper protrusion 370 through the bypass region 375. Accordingly, the movement of the stopper protrusion 370 may not be restricted by the inner stopper 460 during the extending process of the detergent storage unit 300.

In this case, the stopper protrusion 370 bypasses the inner stopper 460 and comes into contact with the opening stopper 275 such that movement thereof is limited. Therefore, the detergent storage unit 300 may extend from the cabinet by a predefined extending distance set by the position of the opening stopper 275.

A length of the detergent storage unit 300 or the location of the stopper protrusion 370 may be determined in various ways by design, and may vary according to a type of the detergent storage unit 300.

When the detergent storage unit 300 according to one implementation of the present disclosure is intended to extend by only the predefined extending distance defined by the opening stopper 275, the bypass region 375 may be defined on a side of the stopper protrusion 370 of the detergent storage unit 300. The bypass region 375 may be located in rear of the inner stopper 460. The inner stopper 460 may pass through the bypass region 375 and may bypass the stopper protrusion 370 in the process of extending the detergent storage unit 300.

In one example, when detergent storage unit 300 intends to use only the inner stopper 460, the bypass region 375 formed on the side of the stopper protrusion 370 may be located in rear of the opening stopper 275, and the stopper protrusion 370 may be constructed to overlap with the inner stopper 460 in the front and rear direction X.

Accordingly, in the process of extending the detergent storage unit 300, the stopper protrusion 370 comes into contact with the inner stopper 460 and thus movement thereof is restricted. When the stopper protrusion 370 bypasses the inner stopper 460 via the pressing of the stopper bar 380, the opening stopper 275 passes through the bypass region 375 and bypasses the stopper protrusion 370, and the stopper protrusion 370 may bypass the opening stopper 275.

In one example, when the detergent storage unit 300 is constructed so that the extending distance thereof is sequentially limited by the inner stopper 460 and the opening stopper 275, the stopper protrusion 370 free of the bypass region 375 may be constructed to overlap the opening stopper 275 and the inner stopper 460 in the front and rear direction X.

Thus, the laundry treating apparatus 10 according to one implementation of the present disclosure has both of the opening stopper 275 and the inner stopper 460. Thus, depending on the type of the detergent storage unit 300 or the location of the stopper protrusion 370, the opening stopper 275 and the inner stopper 460 may be selectively used, and the extending distance of the detergent storage unit 300 may be effectively limited.

FIG. 12 shows the detergent storage unit 300 in which the bypass region 375 overlapping with the inner stopper 460 in the front and rear direction X is located on a side of the stopper protrusion 370 in the lateral direction Y according to one implementation of the present disclosure.

In one example, in one implementation of the present disclosure, one side 276 of the opening stopper 275 in the lateral direction Y overlaps the inner stopper 460 in the front and rear direction X, and the other side 278 thereof does not overlap the inner stopper 460. The stopper protrusion 370 may be constructed to overlap the other side 278 of the opening stopper 275 in the front and rear direction X.

Referring to FIG. 12, in the laundry treating apparatus 10 according to one implementation of the present disclosure, the opening stopper 275 may be constructed so that one side 276 thereof faces the inner stopper 460, while the other side 278 thereof does not face the inner stopper 460. That is, the inner stopper 460 may be constructed to overlap only with one side 276 of the opening stopper 275.

In one example, the stopper protrusion 370 may be constructed not to overlap with the inner stopper 460, and may be constructed to overlap with the other side 278 of the opening stopper 275. That is, the stopper protrusion 370 may be constructed to be spaced from the inner stopper 460 in the lateral direction Y and overlap with a portion of the opening stopper 275 in the rear view as shown in FIG. 12.

Accordingly, in the process of extending the detergent storage unit 300, the stopper protrusion 370 may bypass the inner stopper 460 and contact the opening stopper 275 such that movement thereof is limited.

In other words, the detergent storage unit 300 has the bypass region 375 open along the front and rear direction X of the detergent storage unit 300 on the side of the stopper protrusion 370. The inner stopper 460 is constructed to face the bypass region 375 along the front and rear direction X. In the process of extending the detergent storage unit 300, the inner stopper 460 may pass through the bypass region 375, and the stopper protrusion 370 may be in contact with the opening stopper 275 such that the extending distance thereof may be limited.

However, when the user intends to use both the inner stopper 460 and the opening stopper 275 or when the detergent storage unit 300 is designed to use both the inner stopper 460 and the opening stopper 275, the detergent storage unit 300 may be constructed such that the stopper protrusion 370 overlaps the inner stopper 460, as shown in FIG. 13.

In FIG. 13, one side 276 of the opening stopper 275 may overlap the inner stopper 460 in the front and rear direction X. The stopper protrusion 370 is constructed to overlap with one side 276 of the opening stopper 275 and the inner stopper 460 in the front and rear direction X. In this connection, the detergent storage unit 300 may not have the bypass region 375 on the side of the stopper protrusion 370 as shown in FIG. 13.

The inner stopper 460 overlaps one side 276 of the opening stopper 275 in the front and rear direction X. Thus, the stopper protrusion 370 overlapping the inner stopper 460 in the front and rear direction X may be brought into contact with the opening stopper 275 during the extending process of the detergent storage unit 300.

That is, the opening stopper 275 is constructed such that at least a portion thereof overlaps the inner stopper 460 along the front and rear direction X. The stopper protrusion 370 contacts the inner stopper 460 and the opening stopper 275 in a sequential manner during the extending process of the detergent storage unit 300, thereby limiting the extending distance of the detergent storage unit 300 in a stepwise manner.

For example, the detergent storage unit 300 may extend from the cabinet 100 by the first predefined extending distance when the stopper protrusion 370 contacts inner stopper 460. When the stopper protrusion 370 bypasses the inner stopper 460 using the stopper bar 380, the stopper protrusion 370 comes into contact with the opening stopper 275 again, such that the three storages may extend from the cabinet 100 by the second predefined extending distance.

However, the stopper protrusion 370 should bypass the inner stopper 460 according to the user's intention. Therefore, the stopper bar 380 may be constructed such that the front end thereof is exposed to the outside of the cabinet 100 while the stopper protrusion 370 is in contact with the inner stopper 460.

In one implementation of the present disclosure, as shown in FIG. 12, one side 276 of the opening stopper 275 is positioned side by side with the inner stopper 460 in the front and rear direction X, while the other side 278 thereof is constructed not to overlap with the inner stopper 460. This is advantageous because the use of the inner stopper 460 and the opening stopper 275 may be efficiently selected based on the position of the stopper protrusion 370 according to the replacement or design of the detergent storage unit 300.

As described above, the preferred embodiments according to the present disclosure has been described in detail. However, a person with ordinary knowledge in the technical field to which the present disclosure belongs may implement the present disclosure in various modified manners without deviating from the scope and the spirit of the present disclosure defined in the appended claims. Therefore, the modifications of the embodiments according to the present disclosure may fall into the scope of the present disclosure.

What is claimed is:

1. A laundry treating apparatus comprising:

a cabinet including a front panel that defines a detergent opening;

a tub disposed inside the cabinet;

a drum disposed inside the tub and configured to rotate;

a detergent storage unit configured to be retracted into or extended from the cabinet through the detergent opening, the detergent storage unit being configured to receive detergent and supply the received detergent to the drum; and a protective casing coupled to the front panel, the protective casing being disposed behind the detergent opening and surrounding at least a portion of the detergent storage unit that is retracted into the cabinet, wherein the protective casing has an opening stopper protruding toward the detergent storage unit, wherein the detergent storage unit has a stopper protrusion located behind the opening stopper based on the detergent storage unit being retracted into the cabinet, and wherein the stopper protrusion of the detergent storage unit is configured to, based on the detergent storage unit being extended from the cabinet, contact the opening stopper of the protective casing.

2. The apparatus of claim 1, wherein the protective casing further includes:

an opening protection wall coupled to the front panel, the opening protection wall extending rearward from the detergent opening and surrounding at least a portion of the detergent storage unit that is retracted into the cabinet; and a rear wall disposed behind the detergent opening and connected to the opening protection wall, wherein the rear wall defines a through-opening configured to allow the detergent storage unit to pass through.

3. The apparatus of claim 2, wherein the detergent storage unit has (i) a first portion configured to, based on the detergent storage unit being retracted into the cabinet, be located behind the rear wall, and (ii) a second portion configured to, based on the detergent storage unit being retracted into the cabinet, be located behind the rear wall, be surrounded by the opening protection wall, and contact the rear wall.

4. The apparatus of claim 2, wherein the opening stopper of the protective casing protrudes from an inner peripheral face of the through-opening of the protective casing toward the detergent storage unit.

5. The apparatus of claim 4, wherein the detergent storage unit includes:

a handle positioned at a front end of the detergent storage unit; and a storage frame disposed behind the handle and configured to receive the detergent, wherein the storage frame includes the stopper protrusion, wherein the opening protection wall of the protective casing is configured to surround the handle based on the detergent storage unit being retracted into the cabinet, and wherein the storage frame is configured to pass through the through-opening of the rear wall of the protective casing, and wherein the opening stopper of the protective casing is configured to be located ahead of the stopper protrusion of the detergent storage unit.

6. The apparatus of claim 2, wherein the front panel includes an opening extension extending rearward from a periphery of the detergent opening, wherein the protective casing is coupled to the opening extension and is fixed inside the cabinet.

7. The apparatus of claim 6, wherein an inner face of the opening extension of the front panel faces toward the detergent opening and is covered with the opening protection wall of the protective casing.

8. The apparatus of claim 7, wherein the front panel and the opening extension of the front panel are connected to each other and made from metal, and wherein the opening protection wall of the protective casing includes a plastic material and is constructed to protect the opening extension from the detergent storage unit.

9. The apparatus of claim 1, wherein the detergent storage unit further includes a stopper bar, the stopper bar including the stopper protrusion, wherein the stopper bar has a fixed end and a free end opposite to the fixed end, a position of the free end varying along a protruding direction of the stopper protrusion.

10. The apparatus of claim 9, wherein the stopper bar of the detergent storage unit extends along a retracting direction of the detergent storage unit, a front end of the stopper bar being fixed to the detergent storage unit, and the stopper protrusion being disposed at a rear end of the stopper bar, and wherein the front end of the stopper bar is configured to, based on the stopper protrusion contacting the opening stopper, be exposed to an outside of the cabinet through the detergent opening.

11. The apparatus of claim 10, wherein the protective casing includes a rear wall that is located behind the detergent opening and defines a through-opening configured to allow the detergent storage unit to pass through, wherein the opening stopper of the protective casing is disposed at the rear wall, wherein the detergent storage unit defines a detergent outlet at a rear face of the detergent storage unit, wherein a rear end of a bottom face of the detergent storage unit is located behind the detergent outlet of the detergent storage unit, and wherein the rear end of the bottom face of the detergent storage unit is configured to, based on the stopper protrusion of the detergent storage unit contacting the opening stopper of the protective casing, be located behind the rear wall.

12. The apparatus of claim 10, wherein the stopper protrusion of the detergent storage unit protrudes upward from the detergent storage unit, and wherein the opening stopper of the protective casing protrudes downward from the protective casing.

13. The apparatus of claim 10, further comprising:

a supply casing disposed inside the cabinet, wherein a front end of the supply casing is coupled to the protective casing, wherein the supply casing is configured to accommodate the detergent storage unit that is retracted into the cabinet; and a dispenser disposed above the supply casing and configured to supply washing-water to the detergent storage unit, wherein the dispenser includes an inner stopper protruding toward the detergent storage unit.

14. The apparatus of claim 13, wherein the inner stopper of the dispenser is located behind the opening stopper of the protective casing, and wherein the inner stopper of the dispenser is configured to be located ahead of the stopper protrusion of the detergent storage unit based on the detergent storage unit being retracted into the cabinet.

15. The apparatus of claim 14, wherein the opening stopper of the protective casing and the inner stopper of the dispenser are located above the detergent storage unit and protrude downward, wherein the stopper protrusion of the detergent storage unit protrudes upward from the detergent storage unit, and wherein the stopper protrusion of the detergent storage unit is configured to, based on the detergent storage unit being extended from the cabinet, contact at least one of the opening stopper of the protective casing or the inner stopper of the dispenser to thereby limit an extending distance of the detergent storage unit.

16. The apparatus of claim 15, wherein the stopper protrusion of the detergent storage unit overlaps with the opening stopper of the protective casing and does not overlap with the inner stopper of the dispenser along the retracting direction of the detergent storage unit to thereby allow the stopper protrusion to bypass the inner stopper of the dispenser and contact the opening stopper of the protective casing based on the detergent storage unit being extended from the cabinet.

17. The apparatus of claim 16, wherein a first side of the opening stopper of the protective casing overlaps with the inner stopper of the dispenser, and wherein a second side of the opening stopper of the protective casing does not overlap with the inner stopper of the dispenser in the retracting direction of the detergent storage unit, and wherein the stopper protrusion of the detergent storage unit overlaps with the second side of the opening stopper of the protective casing in the retracting direction of the detergent storage unit.

18. A laundry treating apparatus comprising:

a cabinet including a front panel that defines a detergent opening;

a tub disposed inside the cabinet;

a drum configured to rotate inside the tub;

a detergent storage unit configured to be retracted into or extended from the cabinet through the detergent opening, the detergent storage unit configured to receive a detergent and supply the detergent to the drum;

an inner stopper disposed inside the cabinet and protruding toward the detergent storage unit;

an opening stopper located ahead of the inner stopper and protruding toward the detergent storage unit; and wherein the detergent storage unit includes a stopper protrusion configured to, based on the detergent storage unit being retracted into the cabinet, be located behind the inner stopper, and wherein the stopper protrusion of the detergent storage unit is configured to, based on the detergent storage unit being extended from the cabinet, contact at least one of the inner stopper or the opening stopper to thereby limit an extending distance of the detergent storage unit.

19. The apparatus of claim 18, wherein the apparatus further comprises:

a protective casing coupled to an inner face of the front panel, wherein the detergent storage unit is configured to pass through the protective casing, wherein the protective casing includes the opening stopper; and a dispenser located behind the protective casing and configured to supply washing-water to the detergent storage unit, wherein the dispenser includes the inner stopper.

20. The apparatus of claim 18, wherein the detergent storage unit has a bypass region defined at the stopper protrusion, the bypass region being open along a retracting direction of the detergent storage unit, wherein the inner stopper faces the bypass region along the retracting direction of the detergent storage unit, and wherein the inner stopper is configured to, based on the detergent storage unit being extended from the cabinet, pass through the bypass region, and the stopper protrusion of the detergent storage unit is configured to, based on the detergent storage unit being extended from the cabinet, contact the opening stopper, to thereby limit the extending distance of the detergent storage unit.

* * * * *